US008156852B2

(12) United States Patent
Shibata et al.

(10) Patent No.: US 8,156,852 B2
(45) Date of Patent: Apr. 17, 2012

(54) CUTTING PLOTTER, CUTTING PLOTTER DRIVING CONTROL DEVICE, CUT TARGET MEDIUM SUPPORTING SHEET, CUT TARGET MEDIUM, CUTTING PEN, METHOD OF MANUFACTURING PAPER PRODUCT, AND METHOD OF GENERATING CUT DATA

(75) Inventors: Takeya Shibata, Kanagawa (JP); Yuzuru Sekiguchi, Kanagawa (JP); Michiharu Nishijima, Kanagawa (JP); Tsutomu Tsuji, Kanagawa (JP); Hidemi Koike, Kanagawa (JP); Yutaka Saegusa, Kanagawa (JP); Kousuke Watanabe, Kanagawa (JP); Takayuki Tanigawa, Kanagawa (JP); Toshihiro Houhara, Kanagawa (JP); Shinichi Mukasa, Kanagawa (JP); Kenji Yamamoto, Kanagawa (JP)

(73) Assignee: Graphtec Kabushiki Kaisha, Yokohoma-shi (JP)

( * ) Notice: Subject to any disclaimer, the term of this patent is extended or adjusted under 35 U.S.C. 154(b) by 1500 days.

(21) Appl. No.: 11/036,047

(22) Filed: Jan. 18, 2005

(65) Prior Publication Data

US 2005/0186010 A1 Aug. 25, 2005

(30) Foreign Application Priority Data

| | | |
|---|---|---|
| Jan. 22, 2004 | (JP) | 2004-014707 |
| Jan. 22, 2004 | (JP) | 2004-014709 |
| Jan. 22, 2004 | (JP) | 2004-014710 |
| Jan. 30, 2004 | (JP) | 2004-022445 |
| Feb. 2, 2004 | (JP) | 2004-024943 |
| Feb. 2, 2004 | (JP) | 2004-024944 |
| Feb. 2, 2004 | (JP) | 2004-024945 |
| Mar. 5, 2004 | (JP) | 2004-061898 |
| Aug. 31, 2004 | (JP) | 2004-251207 |

(51) Int. Cl.
*B26D 5/20* (2006.01)
*B26F 1/38* (2006.01)

(52) U.S. Cl. ..... 83/76.1; 83/368; 83/881

(58) Field of Classification Search ..... 83/76.1, 83/76.8, 368, 371, 881
See application file for complete search history.

(56) References Cited

U.S. PATENT DOCUMENTS 3,805,650 A * 4/1974 Pearl ..... 83/56
(Continued)

FOREIGN PATENT DOCUMENTS

EP 0 872 314 A1 10/1998
(Continued)

OTHER PUBLICATIONS

English translation of JP Office Action for Patent Application No. 2004-024943; mailed Sep. 28, 2009.

(Continued)

*Primary Examiner* — Stephen Choi
(74) *Attorney, Agent, or Firm* — Oliff & Berridge, PLC

(57) ABSTRACT

A cut target medium driving type cutting plotter, where a cut target medium to be cut is driven in a first direction and a cutting unit is driven in a second direction perpendicular to the first direction, thereby moving the cutting unit in a two-dimensional direction relative to the cut target medium to make the cutting unit to be selectively brought into press contact with and separated from the cut target medium to cut the cut target medium in a desired shape, the cut target medium driving type cutting plotter includes a cut target medium supporting sheet to removably support the cut target medium on a surface opposite to the cutting unit. Preferably, the cut target medium is driven in the first direction together with the cut target medium supporting sheet, and the cut target medium supported on the cut target medium supporting sheet is cut by the cutting unit.

14 Claims, 21 Drawing Sheets

U.S. PATENT DOCUMENTS

| | | | | |
|---|---|---|---|---|
| 5,537,135 | A | 7/1996 | Hevenor et al. | |
| 5,551,786 | A | 9/1996 | Webster et al. | |
| 5,555,009 | A | 9/1996 | Hevenor et al. | |
| 5,661,515 | A | 8/1997 | Hevenor et al. | |
| 6,112,630 | A | 9/2000 | Miura | |
| 6,664,995 | B2 * | 12/2003 | Milton et al. | 347/218 |
| 2002/0144578 | A1 | 10/2002 | Mikkelsen et al. | |
| 2003/0047045 | A1 | 3/2003 | Alsten et al. | |

FOREIGN PATENT DOCUMENTS

| | | |
|---|---|---|
| JP | A 01-146697 | 6/1989 |
| JP | A 02-155799 | 6/1990 |
| JP | A-02-155799 | 6/1990 |
| JP | A 04-89397 | 8/1992 |
| JP | A 04-212898 | 8/1992 |
| JP | A-04-212898 | 8/1992 |
| JP | U-04-89396 | 8/1992 |
| JP | A 05-069695 | 3/1993 |
| JP | A 05-154790 | 6/1993 |
| JP | A-5-200697 | 8/1993 |
| JP | A-06-190800 | 7/1994 |
| JP | A 07-009689 | 1/1995 |
| JP | A 07-078194 | 3/1995 |
| JP | A 07-156529 | 6/1995 |
| JP | A-08-142587 | 6/1996 |
| JP | A 08-300297 | 11/1996 |
| JP | A 10-34589 | 2/1998 |
| JP | A 10-119484 | 5/1998 |
| JP | A-11-114886 | 4/1999 |
| JP | A 11-129197 | 5/1999 |
| JP | A 11-170195 | 6/1999 |
| JP | A 11-254387 | 9/1999 |
| JP | A 11-268000 | 10/1999 |
| JP | A 2000-288986 | 10/2000 |
| JP | A-2001-9784 | 1/2001 |
| JP | A 2001-038680 | 2/2001 |
| JP | A 2001-063164 | 3/2001 |
| JP | A-2001-105769 | 4/2001 |
| JP | A-2001-121479 | 5/2001 |
| JP | A-2002-11693 | 1/2002 |
| JP | A-2002-137197 | 5/2002 |
| JP | A 2002-166393 | 6/2002 |
| JP | A 2002-211527 | 7/2002 |
| JP | A 2002-239984 | 8/2002 |
| JP | A 2002-346982 | 12/2002 |
| JP | A-2002-346982 | 12/2002 |
| JP | A-2003-136475 | 5/2003 |
| JP | A 2003-220594 | 8/2003 |
| JP | A 2003-305688 | 10/2003 |
| JP | A 2003-320633 | 11/2003 |
| WO | WO 03/034324 A1 | 4/2003 |

OTHER PUBLICATIONS

Japanese Patent Office, *Japanese Office Action for Japanese Patent Application No. 2004-024943* (with English translation), mailed Apr. 27, 2010, pp. 1-3 (pp. 1-6 for translation).

Jan. 26, 2010 Japanese Office Action issued in Application No. JP2004-014709 (with translation).

Jan. 26, 2010 Japanese Office Action issued in Application No. JP2004-014710 (with translation).

Mar. 16, 2010 Japanese Office Action issued in Application No. JP2004-014707 (with translation).

Mar. 16, 2010 Japanese Office Action issued in Application No. JP2004-022445 (with translation).

Mar. 16, 2010 Japanese Office Action issued in Application No. JP2004-251207 (with translation).

Nov. 2, 2010 Office Action issued in Japanese patent application No. 2004-251207 (with translation).

Nov. 2, 2010 Office Action issued in Japanese Patent Application No. 2004-014707 (with translation).

Mar. 11, 2010 Office Action in Japanese Patent Appln. No. 2004-061898 with English translation.

Sep. 21, 2010 Decision of Refusal in Japanese Patent Application No. 2004-24943 and English translation.

Office Action issued Sep. 28, 2010 in Japanese Patent Application No. 2004-024944 (with translation).

Office Action issued Sep. 28, 2010 in Japanese Patent Application No. 2004-024945 (with translation).

Office Action issued Oct. 5, 2010 in Japanese Patent Application No. 2004-022445 (with translation).

* cited by examiner

LINE 3
LINE TYPE: DASHED DOT LINE
LINE COLOR: R 249, G 250, B 250
LINE WIDTH: 0.1mm ± 0.02mm OR 1/4 POINT
COORDINATES: (X31, Y31), (X32, Y32)

HEADER
LINE 1
LINE 2
LINE 3
CHARACTER 1
POINT 1
SURFACE 1
LINE 4

LINE 1
LINE 2
LINE 3
LINE 4

LINE 4
LINE 2
LINE 1
LINE 3
DETECTION OF VECTOR DATA EXTRACTION OF SPECIFIC ATTRIBUTE
SORT

CUTTING PLOTTER, CUTTING PLOTTER DRIVING CONTROL DEVICE, CUT TARGET MEDIUM SUPPORTING SHEET, CUT TARGET MEDIUM, CUTTING PEN, METHOD OF MANUFACTURING PAPER PRODUCT, AND METHOD OF GENERATING CUT DATA

BACKGROUND OF THE INVENTION

1. Field of the Invention

The present invention relates to a cutting plotter, and more particularly, to a cut target medium driving type cutting plotter in which a sheet type of cut target medium moves in a first direction, and in which a cutting means moves in a second direction perpendicular to the first direction at the same time to cut the sheet type medium in a desired shape.

2. Description of the Related Art

As such kinds of cutting plotters for cutting a sheet type medium in a predetermined shape, there has been known a cutting plotter of a cut target medium driving type which has a carriage to move a sheet type medium in a first direction (an X-axis direction) by forwardly and backwardly rotating a driving roller, with both end portions of the sheet type medium interposed between a driving roller and a driven roller (a pinch roller) and to be movable in a second direction (a Y-axis direction) perpendicular to the first direction, and a cutting pen brought into press contact or separated from the sheet type medium provided to the carriage, and which cuts the sheet type medium in a desired shape by moving the cutting pen in a two-dimensional direction with respect to the sheet type medium and by selectively coming into press contact with or separating the cutting pen from the sheet type medium. Further, there has also been known a so-called flat-bed-type cutting plotter which includes a flat plate type table on which a sheet type medium is placed, a Y bar to be movable with respect to the placing table in a first direction, a carriage to be movable in a second direction perpendicular to the first direction by sliding on the Y bar, and a cutting pen mounted to the carriage to come into press contact with or to be separated from the sheet type medium on the placing table, and which cuts the sheet type medium in a desired shape by controlling the movements of the Y bar and the carriage and by selectively bring the cutting pen into press contact with the sheet type medium and by separating the cutting pen from the sheet type medium (for example, see JP-A-2002-346982).

This cutting plotter is used for a sheet type medium printed with (recorded with) a figure, a design, etc., in advance, and for manufacturing the box, the container, etc., by cutting the sheet type medium in development forms of the box, the container, etc., or for manufacturing the paper pattern of clothing, etc., the greeting card, such as the New Year's card, the decorative stencil or master pattern, and the paper products, such as the paper craft, etc.

When a paper sheet is cut by means of the cut target medium driving type cutting plotter, for example, to manufacture a development figure of a box, a container, etc., a paper pattern of clothing, etc., a greeting card, such as a New Year's card, a decorative stencil or a master pattern, and paper products, such as paper crafts, the following troubles can occurs.

That is, in the case of cutting a paper sheet interposed between the driving roller and the pinch roller in a desired shape (hereinafter, referred to as a 'product'), the driving force of the driving roller and the pinch roller are not transmitted to the product. As a result, there occur troubles that the paper sheet material causes a jam phenomenon during the cutting operation, and that the product falls off the paper sheet material and is rolled into between the sheet material and the cutting means to be damaged.

In order to prevent these troubles, in the conventional cutting plotter, a part of cut data is formed of a residual portion, or a portion that is not completely cut is provided by controlling the pressing force of the cutting pen during the cutting operation (a so-called, a half cut). Thereby, the product dose not completely fall off from the paper sheet, and the product portion is cut from an unnecessary portion of the paper sheet material by means of the hands of an operator after the cutting operation.

According to a method of reading a register mark of the cutting plotter, first, a user confirms the position of a pen block in which a sensor for reading a reference figure is provided with the naked eye. Then, the user moves the pen block through a manual operation to position it around (or an immediately upper portion of) a first register mark, serving as a reference. In this state, the cutting plotter moves the pen block in the two-dimensional direction with respect to a sheet type medium and monitors the output of the reference figure reading sensor to detect a figure of one side coordinate axis which forms the register mark. Then, the cutting plotter detects the other side coordinate axis orthogonal to the one side coordinate axis to calculate a positional coordinate of the first register mark. Since the positional relationship between the respective register marks is previously maintained as a set value from printing data formed on the sheet type medium, the cutting plotter moves the pen block from the position of the detected first register mark to the vicinity of the position of a second register mark, and then detects the second register mark in the same method as that used for the first register mark. The cutting plotter detects the position of a third register mark (if necessary, a fourth register mark) in the same method, and on the basis of the position coordinates of the respective register marks detected in this manner, a cutting operation is performed (for example, see JP-A-11-170195).

In this type of cutting plotter for cutting, for example, a sheet-type cutting film in a desired shape, the sheet type medium is cut by, on the basis of cut data transmitted from a host apparatus, such as a computer, moving the pen block holding the cutting pen in the two-dimensional direction with respect to the sheet type medium, and by bring the cutting pen supported by a holder of the pen block into press contact with the sheet type medium or by separating the cutting pen from the sheet type medium.

FIG. 21 is a view showing a configuration of the cutting pen used for this type of cutting plotter. In FIG. 21, reference numeral 51 indicates a plunger serving as a container, reference numeral 55 indicates an extractor screwed with the plunger, reference numeral 56 indicates a pivot bearing attached to a leading end portion of the extractor 55, reference numeral 52 indicates a cutter blade, reference numeral 54 indicates a cap portion serving as a leading end member, reference numeral 53 indicates a bearing attached to the cap portion 54 to rotatably support the cutter blade 52.

Conventionally, in this cutting pen, a projection amount of a leading edge of the cutter blade is adjusted by rotating the extractor 55 to advance or retreat it with respect to the plunger 51. Further, the leading edge of the cutter blade 52 is directed toward its moving direction with the relative movement of the cutting pen to the sheet type medium by the cutter blade 52 being rotatably supported by the pivot bearing 56 and the bearing 53 (for example, see JP-A-10-034589 and JP-A-11-268000).

In the case of cutting off the product from the paper sheet by means of the hands of the operator, particularly in the case of cutting the product in a strip shape, it is necessary to pay a prudent attention when a residual portion is cut off. Thus, the cutting work is complicated. In the case of being unaccustomed to this work, there occurs a trouble that the quality of the product largely deteriorates. In particular, in the case of using a thin weak paper medium as the sheet type medium, such a trouble becomes more serious.

Further, in the case of cutting the paper medium, the leading edge of the blade of the cutting pen, serving as the cutting means, must pass through the paper medium, so that high pressing force (writing pressure) is required. When the thin, weak paper sheet material is cut, in the case of cutting a middle portion between both end portions of the paper sheet material interposed between the driving roller and the pinch roller, a trouble occurs that the sheet material is damaged, which makes it impossible to cut the sheet material. Furthermore, in the case of cutting the paper medium, paper dust is generated from the cut portion, and the paper dust is deposited on the leading edge of the blade to decrease the cutting force. For this reason, troubles, such as the deterioration of cutting quality and a decrease in durability of the cutter blade, occurs.

When the sheet type medium on which figures, etc., are printed in advance is cut by means of the cutting plotter to assemble a box, the printed part of the figure should be exposed on a predetermined position. Therefore, it is necessary to cut the sheet type medium with coordinate axes in an XY plane of the cutting plotter equal to coordinate axes of the record of the sheet type medium. For this reason, in the conventional art, when recording is performed on the sheet type medium, reference figures (a so-called register mark) indicating coordinate axes thereof are formed, and a sensor for reading the reference figure is provided to the pen block of the cutting plotter. Then, the pen block is moved before the cutting operation to cause the reference figure to be read by the sensor to detect the coordinate axes thereof. Subsequently, the cutting operation is performed after correcting cutting data on the basis of the detected coordinate axes. In this way, a positioning operation of the sheet type medium is easily performed, and the coordinate axes of the sheet type medium exactly correspond to the coordinate axes of the cutting plotter.

Further, in general, the operation is performed in the following sequence. The figure, design, etc., formed on the surface of the sheet type medium are drawn in advance with graphic software. Profile data, etc., which should cut the sheet type medium is generated by application software generating cut data of the cutting plotter, apart from, but in conformity with, image data generated by the graphic software. On the basis of the image (printing) data generated by the graphic software, recording is performed on the surface of the sheet type medium by a recording device, such as a printer. Then, the sheet type medium to which the record has been completely performed is set to the cutting plotter and is then cut.

In the image data generating work, cut data generating work, printing, cutting, etc., which are performed in this sequence, a format of the image data for recording and printing should be different from that of the cut data for cutting. For these works, knowledge is required to some extent, so that these works cause a person unaccustomed to the operation of the cutting plotter to feel very complicated, and generate a trouble in that the manufacture of the box and container, or the manufacture of the paper pattern of the clothing, etc., the decorative stencil or master pattern, the greeting card, such as the New Year's card, the paper products, such as the paper craft, etc., cannot be easily carried out.

In the conventional cutting plotter, as mentioned above, it is essentially necessary for the operator to manually perform the movement and positional selection of the pen block with respect to the first register mark, acting as a reference, on detecting the position of the register mark, which is a reference figure, while looking at the work in person. This is because a cutting start point (or a starting point serving as reference) is not fixed, particularly, in the abovementioned flat bed type cutting plotter, and thus the sheet type medium to be cut is placed at an arbitrary position on the table. Therefore, such a work is for setting the start point when the cutting operation is performed and for detecting the position of the first register mark formed on the sheet type medium. However, it is very difficult to automatically detect the position of the first register mark, and a little knowledge is needed to perform the works. Thus, it is very complicated for the person unaccustomed to the operation of the cutting plotter to perform the works. Accordingly, there is a trouble that everybody cannot easily cut the-sheet type medium by means of the cutting plotter.

In the case of cutting the sheet type medium by means of the cutting plotter, various kinds of operational conditions are prepared for high-quality cutting. For instance, a drawing speed (namely, the movement speed of the cutting pen), acceleration (the movement acceleration of the cutting pen), writing pressure (the pressure of the cutting pen with respect to the sheet type medium), offset compensation amount (the offset amount of the cutting initial point), and a type of pen (the projection amount or shape of the leading edge of the blade of the cutting pen) are prepared as the operational conditions. Among them, the drawing speed and the acceleration are connected with the precision of the cut figure to be prepared. It is preferable that these values be set to be small in the case of preparing a slim cut figure, and that these values be set to be great in the case of intending to shorten a whole time for the cutting operation. Further, the writing pressure is connected with the thickness or stiffness of the sheet type medium to be cut. Preferably, the writing pressure is set to be great with respect to a thick or rigid medium. It is possible to perform good-quality cutting by setting proper writing pressure according to the thickness or stiffness of the sheet type medium to be cut. In addition, the offset compensation amount and the pen type (the projection amount of the leading edge of the blade of the cutting pen) are connected with the thickness or stiffness of the cutting film to be cut. In this manner, these operational conditions are prepared together with many setting values corresponding to various kinds of sheet type medium to be cut inclusive of the various kinds of cutting films. Conventionally, for these cutting conditions, it is repeated that the operator presets the setting values determined to be proper before the cutting operation, cuts the sheet type medium in a predetermined pattern within an unnecessary region before the cutting operation, that is to say, performs test cutting, and checks the results to set the various conditions again. After the setting values at which optimal results are obtained are determined, the cutting operation is performed.

Therefore, in order to rapidly find the optimal operational conditions, it is required to depend on the experience of the operator or to repeatedly perform the test cutting operation. For this reason, the setting of these various operational conditions is very complicated to the person unaccustomed to this operation. Further, in the case of changing the target to be cut into another kind of sheet material, this setting work of the operational conditions is performed again, which is a complicated work.

When the sheet type medium is cut by the cutting plotter using the cutting pen, and when the sheet type medium to be cut is a so-called cutting film configured in such a manner that an adhesive sheet is stacked on a template paper through an adhesive, etc., and that a target to be cut is only the adhesive sheet portion. Hence, the operator needs to adjust the projection amount of the leading edge of the cutter blade of the cutting pen, according to the thickness of the adhesive sheet. The adjustment of the projection amount of the leading edge of the cutter blade is performed in such a manner that the cutter blade 52 is advanced or retreated by rotating the extractor 55, and that the projection amount of its end, i.e., the projection amount of the edge of the cutter blade 52 with respect to a lower end of the cap portion 54 coming into contact with the surface of the adhesive sheet when the cutting pen 5 is brought into press contact with the sheet type medium is kept either to be equal to the thickness of the adhesive sheet of the sheet type medium or not to completely pass through the template paper. In fact, since the projection amount of the edge of the cutter blade is slight, the operator cuts the sheet type medium in a predetermined pattern within its unnecessary region before the cutting operation in the prior art, that is, performs test cutting, and checks the cut results to readjust the projection amount. In this manner, the operator repeats these processes to set the optimal projection amount, and then performs the cutting operation.

Thus, in order to rapidly find the optical projection amount, it is required to depend on the experience of the operator or to repeatedly perform the test cutting. For this reason, the person unaccustomed to this operation suffers from a very complicated adjustment of the project amount. Further, in the case of changing the target to be cut into another material, such as a paper sheet material, it is necessary to perform the adjustment of the projection amount again. In addition, the adjustment work should be performed whenever the medium is changed, which is a complicated work.

SUMMARY OF THE INVENTION

In a cut target medium driving type cutting plotter of the present invention, it is a feature that a cut target medium supporting sheet for removably supporting a paper sheet material, which is a cut target medium, on a surface opposite to a cutting means is provided, and both end portions of the cut target medium supporting sheet supporting the paper sheet material are interposed between a driving roller and a driven roller.

In the cutting plotter of the present invention, cut data is composed of image data formed in a predetermined format and having at least vector element data, and only the vector element data having specific attributes among the image data is used as the cut data. Then, a cutting operation is performed on the basis of the vector element data.

In the cutting plotter of the present invention, a storage means for storing and holding various setting conditions corresponding to types of the cut target medium is provided, and the setting conditions corresponding to the types of the cut target medium are read from the storage means to perform the cutting operation on the basis of the read setting conditions.

In the cutting plotter of the present invention, a reading sensor moved in a two-dimensional direction relative to the cut target medium to detect a reference mark provided on the cut target medium is moved from a reference point determined by an operation starting point of the cutting means along a preset locus to detect the reference mark.

In a cut target medium driving type cutting plotter of the present invention, a cut target medium supporting sheet for removably supporting a paper sheet material, which is a cut target medium, on a surface opposite to a cutting means is used to interpose the cut target medium supporting sheet supporting the paper sheet material between a driving roller and a driven roller. Then, the cut target medium supporting sheet is moved in a first direction, and a cutting pen is moved in a second direction perpendicular to the first direction to cut the paper sheet material.

In a cut target medium of the cut target medium driving type cutting plotter of the present invention, the cut target medium includes a sheet type member, an adhesive layer formed on a surface of the sheet type member, and sheet type paper removably supported on the adhesive layer, and both end portions of the cut target medium are interposed between a driving roller and a driven roller to move them in a first direction. Further, a cutting means is moved in a second direction to cut the sheet type paper removably supported on the adhesive layer in a desired shape.

In a cutting pen of the present invention, a cap portion is detachably provided to a holder supporting a cutter blade, and a projection amount of a leading end of the cutter blade is determined when the cap portion is attached.

In a method of manufacturing a paper product by using a cut target medium driving type cutting plotter of the present invention, it is a feature that it is configured to use a cut target medium supporting sheet for removably supporting a paper sheet material as a cut target medium to be cut, to insert both ends of the cut target medium supporting sheet supporting the paper sheet material between a driving roller and a driven roller to be moved in a first direction, to move a cutting means in a second direction perpendicular to the first direction, and to thereby cut the paper sheet material on the cut target medium supporting sheet. Further, it is configured to use the cut target medium obtained by laminating the paper sheet material and the supporting member for removably supporting the paper sheet material, to insert both ends of the cut target medium supporting sheet supporting the paper sheet material between the driving roller and the driven roller to be moved in the first direction, to move the cutting means in the second direction perpendicular to the first direction, and to thereby cut the paper sheet material on the cut target medium supporting sheet.

In the cutting plotter of the present invention, it is configured to form cut data by means of image data formed in a predetermined format having at least vector element data, to use only the vector element data having specific attributes among the image data, which is the cut data, and to perform cutting on the basis of the vector element data.

In the cut target medium driving type cutting plotter of the present invention, the paper sheet material is removably supported on the supporting sheet and is then cut. Hence, the product portion does not fall away from the other sheet material portion although the paper sheet material is completely cut without forming any residual portion on the paper sheet material, and it is easy to strip off the fruit portion. Further, in the case of cutting the thin, weak paper sheet material, it is possible to excellently cut the paper sheet material.

According to the method of generating the cut data of the cutting plotter of the present invention, it is possible to describe the cut data as the object information that is one of the general purpose image data files, so that it is possible to improve the convenience of use as well as to perform recording by a printer, etc., and cutting by the cutting plotter on the basis of one image data.

In the cutting plotter of the present invention, the various setting conditions corresponding to types of the cut target medium may be stored and held in the storage means in advance, and the various setting conditions corresponding to types of the medium to be cut are read out from the storage means to perform cutting on the basis of the read results.

Hence, it is unnecessary for the operator to perform the complicated selection of the setting conditions.

In the cutting plotter of the present invention, it is possible to automatically detect the reference mark provided on the cut target medium without troublesome intervention of the operator.

In the cut target medium supporting sheet of the cut target medium driving type cutting plotter of the present invention, the adhesive layer for removably adhering and supporting the cut target medium is formed on the surface opposite to the cutting means, and the paper sheet material is supported and cut on the adhesive layer. Hence, the product portion does not fall away from the other sheet material portion although the paper sheet material is completely cut without forming any cut residual portion on the paper sheet material, and it is easy to strip off the product portion. Further, in the case of cutting the thin, weak paper sheet material, it is possible to excellently cut the paper sheet material.

In the cut target medium of the cut target medium driving type cutting plotter of the present invention, the sheet type paper removably adhered and supported on the supporting sheet is cut. Hence, the product portion does not fall away from the other sheet material portion although the paper sheet material is completely cut without forming any cut residual portion on the paper sheet material, and simultaneously can easily be stripped off.

In the cutting pen of the present invention, when the cap portion is attached to the holder, the projection amount of the leading end of the cutter blade projecting from the lower end surface of the cap portion becomes a preset specific projection amount. Hence, when the cap portion has only to be attached according to the type of the medium to be cut, it is possible to set the optimal projection amount of the leading end of the cutter blade.

In the method of manufacturing a paper product using the cut target medium driving type cutting plotter of the present invention, the paper sheet material removably supported on the supporting sheet is cut. Hence, the product portion does not fall away from the other sheet material portion although the paper sheet material is completely cut without forming any cut residual portion on the paper sheet material, and can be easily stripped off. Further, in the case of cutting the thin, weak paper sheet material, it is possible to excellently cut the paper sheet material.

According to the method of preparing the cut data of the cutting plotter of the present invention, it is possible to describe the cut data as the object information that is one of the general purpose image data files, so that it is possible to improve the convenience of use as well as to perform recording by a printer, etc., and cutting by the cutting plotter on the basis of one image data.

BRIEF DESCRIPTION OF THE DRAWINGS

FIGS. 15A and 16B are views showing the cutting operation of the cutting plotter of the present invention;

DETAILED DESCRIPTION OF THE INVENTION

A configuration is made to use a cut target medium supporting sheet removably supporting a paper sheet material to be cut, to insert the cut target medium supporting sheet supporting the paper sheet material between a driving roller and a driven roller, to move the cut target medium supporting sheet in a first direction and a cutting pen in a second direction perpendicular to the first direction, thereby cutting the paper sheet material.

[First Embodiment]

A cutting plotter of a cut target medium driving type of the present invention will be described with reference to the following drawings.

Figure 1:
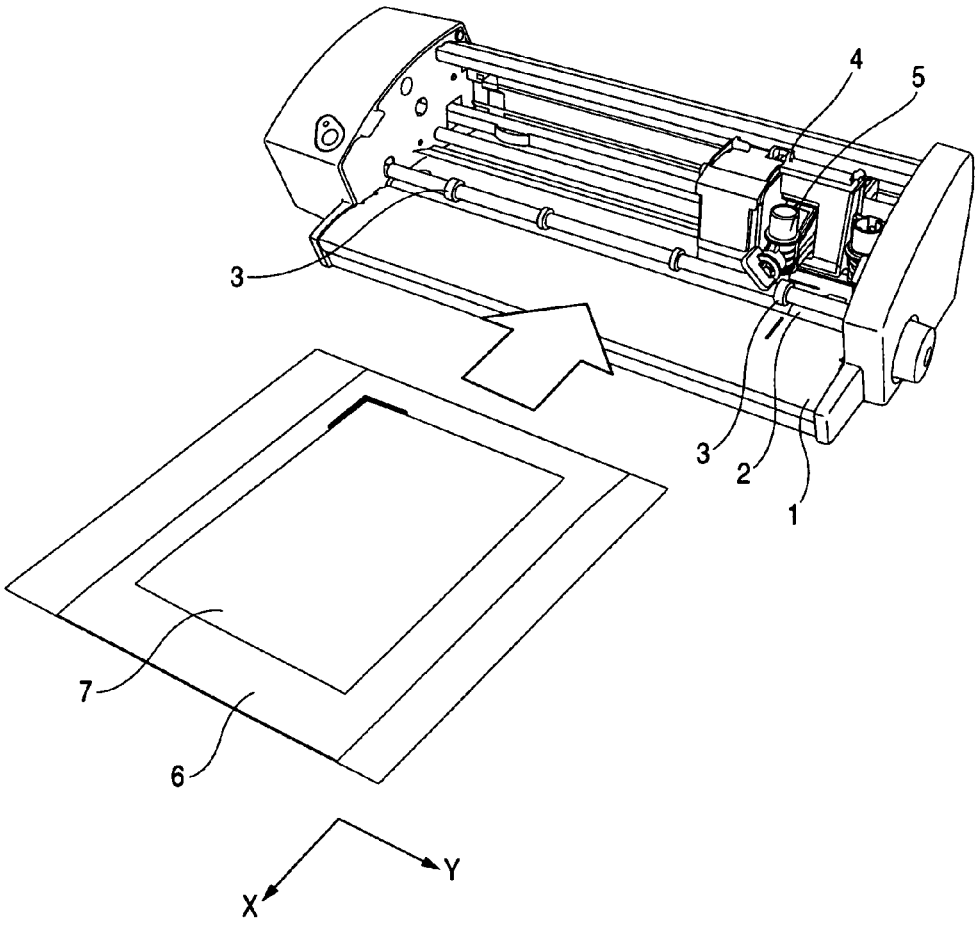
FIG. 1 is a view showing a configuration of a cut target medium driving type cutting plotter of the present invention.

FIG. 1 is a view showing a configuration of a cut target medium driving type cutting plotter of the present invention. In FIG. 1, reference numeral 1 indicates a main body of the cutting plotter, reference numeral 2 indicates a driving roller, reference numeral 3 indicates a pinch roller, reference numeral 4 indicates a pen block, reference numeral 5 indicates a cutting pen, reference numeral 6 indicates a supporting sheet of a cut target medium, and reference numeral 7 indicates a paper sheet material serving as the cut target medium.

In the cut target medium driving type cutting plotter of the present invention, the paper sheet material 7 serving as the cut target medium is placed and supported on the cut target medium supporting sheet 6, and both end portions of the cut target medium supporting sheet 6 is interposed between the driving roller 2 and the pinch roller 3. The driving roller 2 is supported on the main body 1 so as to be rotated by the forward or backward rotation force transmitted from a driving motor (not shown). The pinch roller 3 is pressed by the driving roller 2 with the cut target medium supporting sheet 6 interposed therebetween, and thus is rotated according to the forward or backward rotation of the driving roller 2. The cut target medium supporting sheet 6 has both the end portions interposed between the driving roller 2 and the pinch roller 3, and is driven in an X-axis direction of the drawing by the rotation of the driving roller 2. The pen block 4 is provided to be movable in a Y-axis direction of the drawing on the main body 1 of the cutting plotter by means of a moving mechanism, which is not shown. Further, the pen block 4 is mounted with the cutting pen 5, serving as a cutting means, and is provided to be brought into press contact with and separated from the cut target medium 7 by going down and up the cutting pen 5 by means of an actuator (not shown).

A control means is configured to control the driving roller 2 on the basis of cut data for a shape to be cut to move the cut target medium supporting sheet 6 in the X-axis direction (first direction) of the drawing together with the cut target medium 7, to move the pen block 4 in the Y-axis direction (second direction), and to selectively bring the cutting pen 5 into press contact with or separate it from the paper sheet material 7, thereby cutting the paper sheet material 7 in a desired shape.

Figure 2:
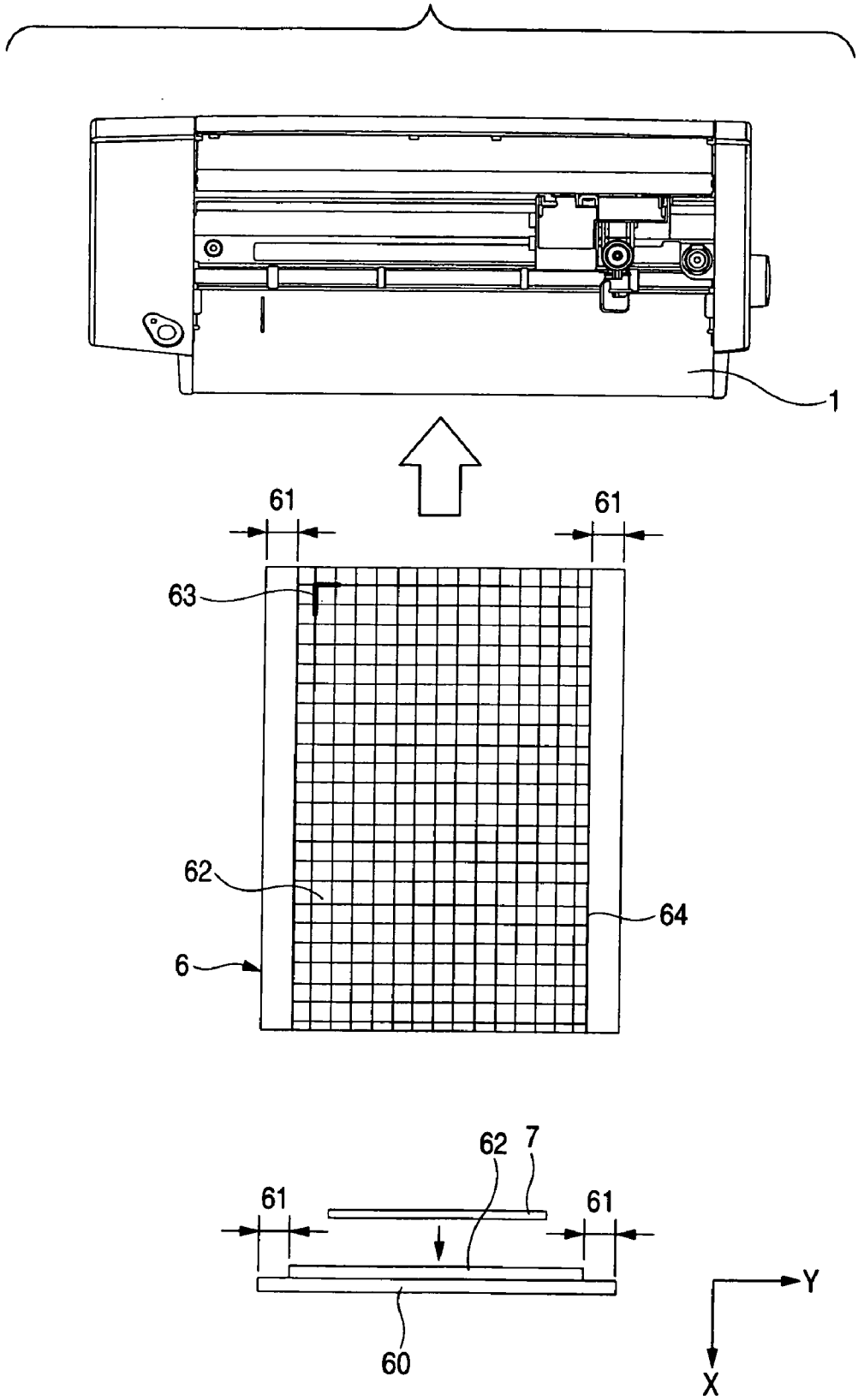
FIG. 2 is a view showing a cut target medium supporting sheet of the present invention.

FIG. 2 is a view showing the cut target medium supporting sheet 6 of the present invention. The cut target medium supporting sheet 6 is composed of a base 60 of a sheet type and an adhesive layer 62 for adhering and supporting the cut target medium 7 on a surface opposite to the cutting pen 5 of the base 60 in a removable manner. Of both end portions of the base 60, the portions where the adhesive layer 62 is not formed are made up of holding parts 61 corresponding to portions interposed between the driving roller 2 and the pinch roller 3 of the cutting plotter.

As the base 60, for example, a thin plastic sheet is used. An adhesive layer 62 on which an adhesive having weak adhesive strength is applied is formed on the base 60. The adhesive having weak adhesive strength is used in the adhesive layer 62, so that the paper sheet material 7 serving as the cut target medium can be supported removably and used repeatedly. To be specific, as the base 60, paperboard for paper containers, white paperboard, special paperboard, white lined board (e.g., 'NEW-DV' available from Hokuetsu Package Co. Ltd, 'High Pearl' available from Mitsubishi Paper Mills Limited, etc.) or a PET film having a thickness of about 0.1 mm to 0.3 mm (e.g., 'Mylar' available from Dupont), a polycarbonate film or so forth may be employed. Further, as the adhesive layer 62, a double-sided adhesive tape, a fastener (e.g., 'Refill' available from Lynntech, '4591HL' available from 3M, 'Daitech' available from Dai Nippon Printing Co. Ltd, etc.), or an aerosol adhesive (e.g., 'Spray paste 55 color' available from 3M, etc.) may be employed. A reference mark 63 for facilitating to position the paper sheet material 7 when supporting the paper sheet material 7 is marked on the surface of the adhesive layer 62, together with a grid-shaped graph paper scale 64. For each of these indexes, the reference mark 63 is for matching the origin located on the cut target medium supporting sheet 6 with coordinate axes (X- and Y-axes) of the cutting plotter, and the graph paper scale 64 is for matching the paper sheet material 7 with the coordinate axes (X- and Y-axes) of the cutting plotter.

In the case of cutting the paper sheet material in a desired shape by means of the medium driving type cutting plotter of the present invention to manufacture a paper product, first, the operator supports the paper sheet material 7 as a material on the cut target medium supporting sheet 6. At this time, the paper sheet material 7 causes its ends to be positioned to be parallel to the graph paper scale 64 so as to coincide with the reference mark 63 and simultaneously not to lean to the cut target medium supporting sheet 6.

As mentioned above, because the adhesive layer 62 is formed of the adhesive having the weak adhesive strength, the paper sheet material 7 is adhered, supported, and fixed to the entire surface of the cut target medium supporting sheet 6.

Subsequently, both the ends 61 of the cut target medium supporting sheet 6 on which the paper sheet material 7 is supported are inserted between the driving roller 2 and the pinch roller 3 of the cutting block. This state is a standby state of the cutting plotter.

When the cut target medium supporting sheet 6 supporting the paper sheet material 7 is set to the cutting plotter 1, cut data for cutting is transmitted from a host apparatus, such as a computer, and a control unit of the cutting plotter, which is not shown, performs a cutting operation on the paper sheet material 7 on the basis of the cut data.

In the cutting operation of the paper sheet material 7, while bringing the cutting pen 5 into press contact with or separates it from the paper sheet material 7 by the actuator of the pen block 4, which is not shown, the control unit moves the pen block 4 mounted with the cutting pen 5 in the Y-axis direction and rotates the driving roller 2, thereby moving the cut target medium supporting sheet 6 supporting the paper sheet material 7 in the X-axis direction. In this way, the cutting pen 5 moves in the two-dimensional direction with respect to the paper sheet material 7 on the basis of the cut data, and thus the paper sheet material 7 is cut.

In this cutting operation, the projection amount of the leading edge of the blade is set such that the cutting pen 5 descends until the leading edge of the blade of the cutting pen 5 cuts (passes through) the paper sheet material 7 to arrive at the adhesive layer 62 (or the base 60) and until the leading edge of its own blade arrives at a height where it does not completely pass through the base 60, and in this state, the pen block 4 and the driving roller 2 are driven to cut the paper sheet material 7, or such that the leading edge of its own blade cuts the paper sheet material 7 when the cutting pen 5 comes into press contact with the paper sheet material 7.

Therefore, the product manufactured by the cutting operation is completely separated from the paper sheet material 7. However, after the separation, since the product is still being held on the adhesive layer 62, the product does not fall away from the cut target medium supporting sheet 6.

When the cutting operation is completed, the cut target medium supporting sheet 6 is extracted by releasing engagement between the pinch roller 3 and the driving roller 2, and the product portion is stripped off and separated from the cut target medium supporting sheet 6. At this time, since the product portion is completely separated from the paper sheet material 7 and the adhesive strength of the adhesive layer 62 is weak, the product portion can be stripped off in a simple and easy manner.

Further, since paper dust caused by cutting the paper sheet material 7 adheres to the adhesive layer 62, the paper dust is not deposited on the leading edge of the blade of the cutting pen 5.

When an unnecessary portion of the paper sheet material 7 is removed from the cut target medium supporting sheet 6 from which the product portion is stripped off, a new paper sheet material 7 can be supported on the cut target medium supporting sheet 6 to use for the next cutting operation. The cut target medium supporting sheet 6 can be repeatedly used until the adhesive strength of the adhesive layer 62 deteriorates.

Further, the cut target medium supporting sheet is formed of a thin plastic sheet, etc., so that it is possible to excellently cut the paper sheet material 7 although the paper sheet material 7 to be cut is formed of a thin, weak material, such as tracing paper.

[Second Embodiment]

In the above-mentioned embodiment, the cut target medium supporting sheet 6 is formed by providing the adhesive layer 62 on the base 60 made up of a plastic sheet, etc., and the paper sheet material 7 serving as a cut target medium is adhered on the adhesive layer 62. However, the cut target medium supporting sheet 6 made up of a paper material or vinyl-chloride sheet may come into press contact with the paper sheet material 7 serving as the cut target medium using a pressure sensitive adhesive.

In this case, the paper sheet material 7 to be cut is pre-compressed against the cut target medium supporting sheet 6 through the pressure sensitive adhesive to be removably pseudo-compressed. In the cutting operation, the descent or press contact of the cutting pen 5 is controlled such that the leading edge of the blade of the cutting pen 5 cuts the paper sheet material and also does not completely pass through the cut target medium supporting sheet 6.

After completing the cutting operation, the operator strips off the product portion of the paper sheet material 7 from the cut target medium supporting sheet 6. In the present embodiment, as the pressure sensitive adhesive, for example, a polyurethane, acryl- or rubber-based pressure sensitive adhesive may be used.

[Third Embodiment]

Figure 3:
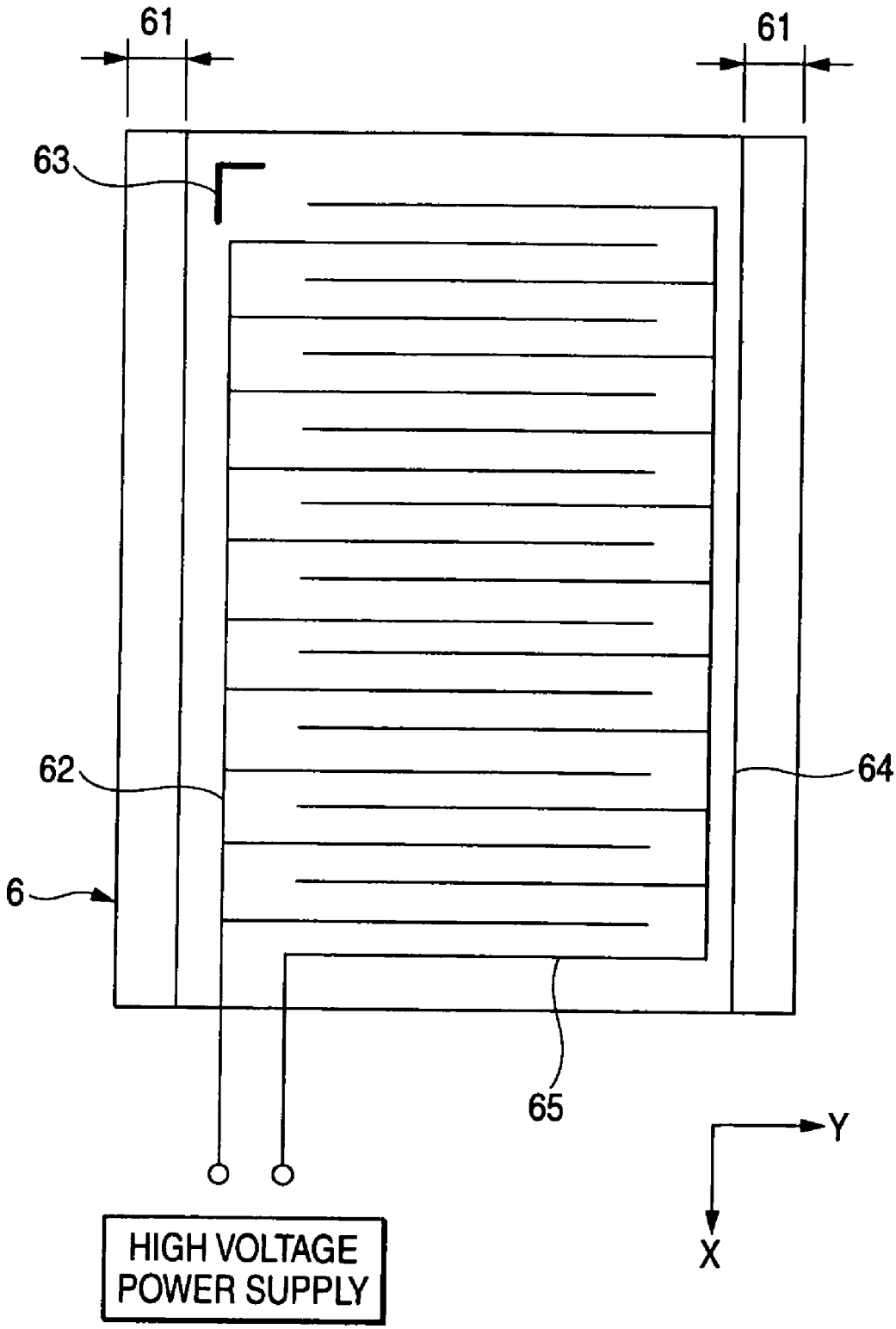
FIG. 3 is a view showing a third embodiment of the cut target medium supporting sheet according to the present invention.

FIG. 3 is a view showing another embodiment of the cut target medium supporting sheet in the cut target medium driving type cutting plotter of the present invention. In this embodiment, the base 60 of the cut target medium supporting sheet 6 is formed by laminating two resin material sheets having flexibility, and a pair of electrode patterns 65 is formed between the respective bases 60. In this way, electrostatic adsorption power is generated on the surface of the cut target medium supporting sheet 6 by selectively connecting a high power supply to the electrode patterns 65.

In the case of cutting the paper sheet material using the cut target medium supporting sheet of the present embodiment, after positioning the paper sheet material 7 on the cut target medium supporting sheet 6, the operator connects the high power supply to the electrode patterns 65 to generate the electrostatic adsorption power on the surface of the cut target medium supporting sheet 6, thereby adsorbing and fixing the paper sheet material 7.

In this state, both ends 61 of the cut target medium supporting sheet 6 on which the paper sheet material 7 is supported is intervened between the driving roller 2 and the pinch roller 3 of the cutting plotter. Cut data for cutting is transmitted from a host apparatus, such as a computer, and the cutting operation of the paper sheet material 7 is performed on the basis of the cut data.

In the case of the present embodiment, the cutting pen 5 descends until the leading edge of its own blade arrives at a height where it cuts only the paper sheet material 7 and not the base 60, and in this state, the pen block 4 and the driving roller 2 are driven to cut the paper sheet material 7.

When the cutting operation is completed, the connection of the electrode patterns 65 and the high power supply is released by the operator, and the product portion of the paper sheet material 7 and the other portions are stripped off from the cut target medium supporting sheet 6. In the case of the present embodiment, the connection or disconnection of the electrode patterns 65 and the high power supply makes the paper sheet material 7 selectively adsorbed or separated, so that it is possible to facilitate the separation of the product.

The cut data are described as vector element data having specific attributes and as an object of one of image data files.

[Fourth Embodiment]

Figure 4:
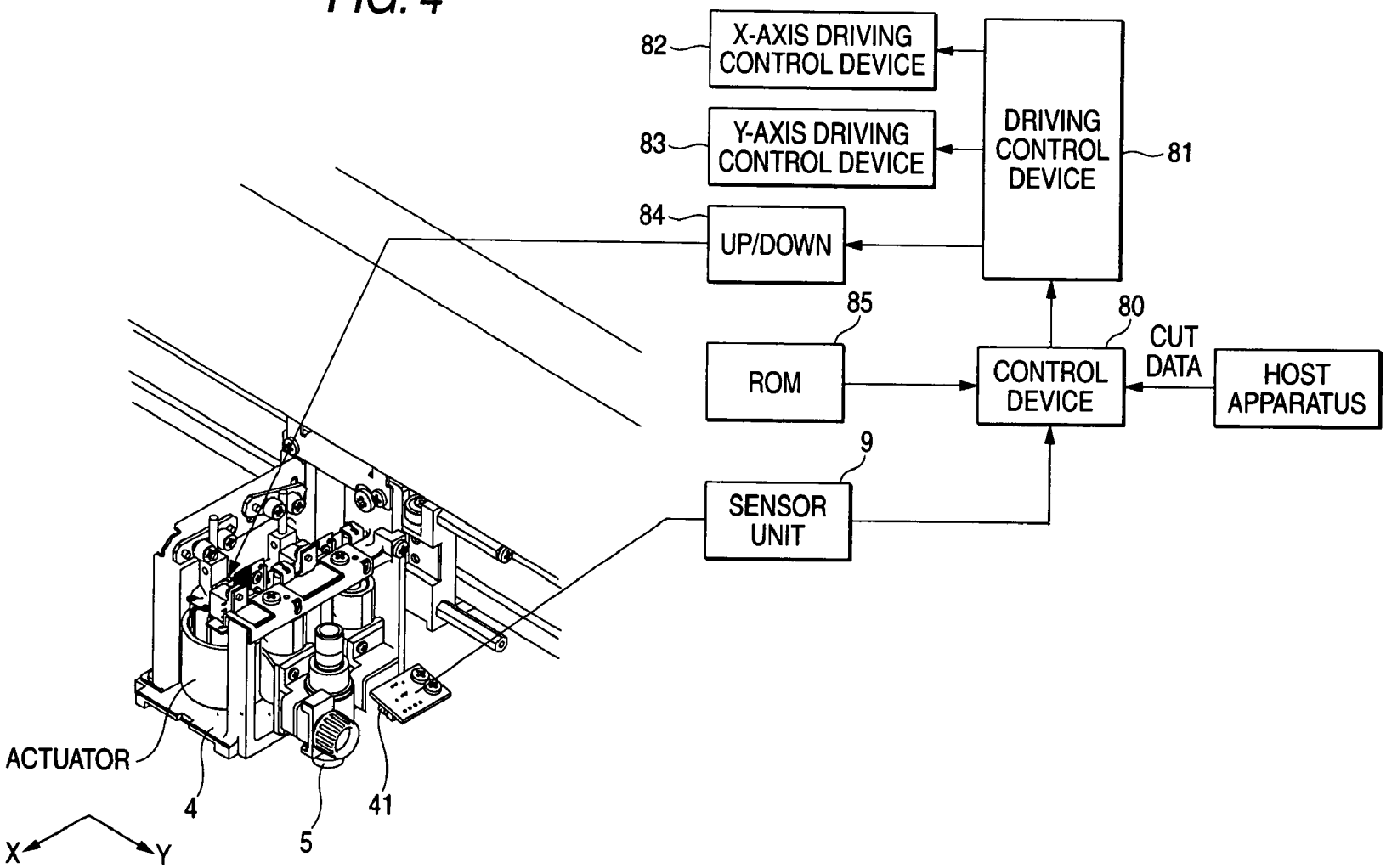
FIG. 4 is a block diagram showing a configuration of a cutting plotter according to the present invention.

FIG. 4 is a functional block diagram showing a configuration of the medium driving type cutting plotter. In FIG. 4, reference numeral 8 indicates a control unit for performing various kinds of controls and includes a control device 80 for generating cut data by the cutting pen 5 on the basis of cut data or recorded data transmitted from a host apparatus, such as a computer, and a driving controller 81 for controlling the driving of an X-axis driving control means 82, a Y-axis driving control means 83, and a Z-axis driving control means 84 on the basis of the cut data transmitted from the control device 80. The X-axis driving control device 82 controls the driving of a driving motor which rotates the driving roller 2 in a forward or backward direction. The Y-axis driving control device 83 controls the driving of a driving motor which moves the pen block 4 in the Y-axis direction. The Z-axis driving control means 84 controls the driving of an actuator for bringing the cutting pen 5 into press contact with or for separating it from the paper sheet material 7. The pen block 4 is provided with a reference figure detecting sensor 41 for detecting a reference figure to be described below, and the reference figure detecting sensor 41 is composed of a reflective photo sensor and detects the coordinate points of X and Y axes of the reference figure to transmit these reference figure data to the control device 80.

In the case of cutting the paper sheet material in a desired shape by means of the medium driving type cutting plotter to manufacture a paper product, first, the operator supports the paper sheet material 7 as a material on the cut target medium supporting sheet 6.

Since the cut target medium supporting sheet 6 is provided with an adhesive layer formed with an adhesive having weak adhesive strength on the surface thereof, the entire surface of the paper sheet material 7 is adhered, supported, and fixed to the cut target medium supporting sheet 6.

Subsequently, both ends of the cut target medium supporting sheet 6 on which the paper sheet material 7 is supported are inserted between the driving roller 2 and the pinch roller 3 of the cutting block. At this time, a reference mark, that is, a starting point of the paper sheet material 7 is positioned to be close to the pinch roller 3. In this state, the cutting plotter becomes a standby state.

When the cut target medium supporting sheet 6 supporting the paper sheet material 7 is set to the cutting plotter 1, cut data for cutting is transmitted from a host apparatus, such as a computer, and a control unit of the cutting plotter, which is not shown, performs a cutting operation on the paper sheet material 7 on the basis of the cut data.

In the cutting operation of the paper sheet material 7, the control unit makes the cutting pen 5 come into press contact with or separated from the paper sheet material 7 by the actuator of the pen block 4 that is not shown to move the pen block 4 holding the cutting pen 5 in the Y-axis direction and to simultaneously rotate the driving roller 2, thereby moving the cut target medium supporting sheet 6 supporting the paper sheet material 7 in the X-axis direction. In this way, the cutting pen 5 moves in a two-dimensional direction relative to the paper sheet material 7 on the basis of the cut data, and thus the paper sheet material 7 is cut.

In this cutting operation, the projection amount of the leading edge of the blade of the cutting pen 5 is set such that the leading edge of the blade of the cutting pen 5 cuts (passes through) the paper sheet material 7 to arrive at the adhesive layer, and in this state, driving the pen block 4 and the driving roller 2 are driven to cut the paper sheet material 7, or such that, when the cutting pen 5 is brought into press contact with the paper sheet material 7, the leading edge of the blade of the cutting pen 5 cuts (passes through) the paper sheet material 7.

Therefore, the product manufactured by the cutting operation is stripped off and separated from the paper sheet material 7. However, after the separation, since the product is still held on the adhesive layer, the product does not fall away from the cut target medium supporting sheet 6.

When the cutting operation is completed, the cut target medium supporting sheet 6 is extracted by releasing the engagement between the pinch roller 3 and the driving roller 2, and the product portion is stripped off and separated from the cut target medium supporting sheet 6. At this time, since the product portion is completely separated from the paper sheet material 7 and the adhesive strength of the adhesive layer 62 is weak, the product portion can be stripped off in a simple and easy manner.

Further, since the paper dust generated by cutting the paper sheet material 7 is adsorbed to the adhesive layer, the paper dust is not deposited on the leading edge of the blade of the cutting pen 5.

When an unnecessary portion of the paper sheet material 7 is removed from the cut target medium supporting sheet 6 where the product portion has been stripped off, a new paper sheet material 7 can be supported on the cut target medium supporting sheet 6 to use for the next cutting operation. Therefore, the cut target medium supporting sheet 6 can be repeatedly used until the adhesive strength of the adhesive layer 62 deteriorates.

Further, the cut target medium supporting sheet is formed of a thin plastic sheet, etc., so that it is possible to excellently cut the paper sheet material 7 although the paper sheet material 7 to be cut is formed of a thin, weak material, such as tracing paper.

In the case of manufacturing paper products having records on their surfaces, such as the development figures of boxes, containers etc., or greeting cards, such as New Year's cards, by means of this type of cutting plotter, there is used a method of manufacturing paper products by performing recording on the paper sheet material 7 by means of a printer, etc., in advance and by cutting the outlines of the recorded figures by means of the cutting plotter. In this case, in the printing of the figure carried out on the surface of the paper sheet material 7 in advance, it is necessary to exactly match coordinate axes of an X-Y plane of the cutting plotter with those of the record printed on the paper sheet material 7 in order for the printed portion of the figure to appear at a predetermined position when cutting the paper sheet material to assemble, for example, a box. In order to match the coordinate axes of the cutting plotter and the paper sheet material 7, figures, etc., are printed on the paper sheet material 7, and reference figures (so-called register marks) indicating the coordinate axes are formed thereon. Further, in the cutting plotter, the pen block is moved by means of a sensor mechanism provided in the pen block before the cutting operation to detect the coordinates of the reference figure, and the cut data is corrected on the basis of the detected coordinate axes to perform the cutting operation. In this way, the coordinate axes of the record formed on the paper sheet material 7 exactly coincide with the coordinate axes of the cutting plotter.

Figure 5:
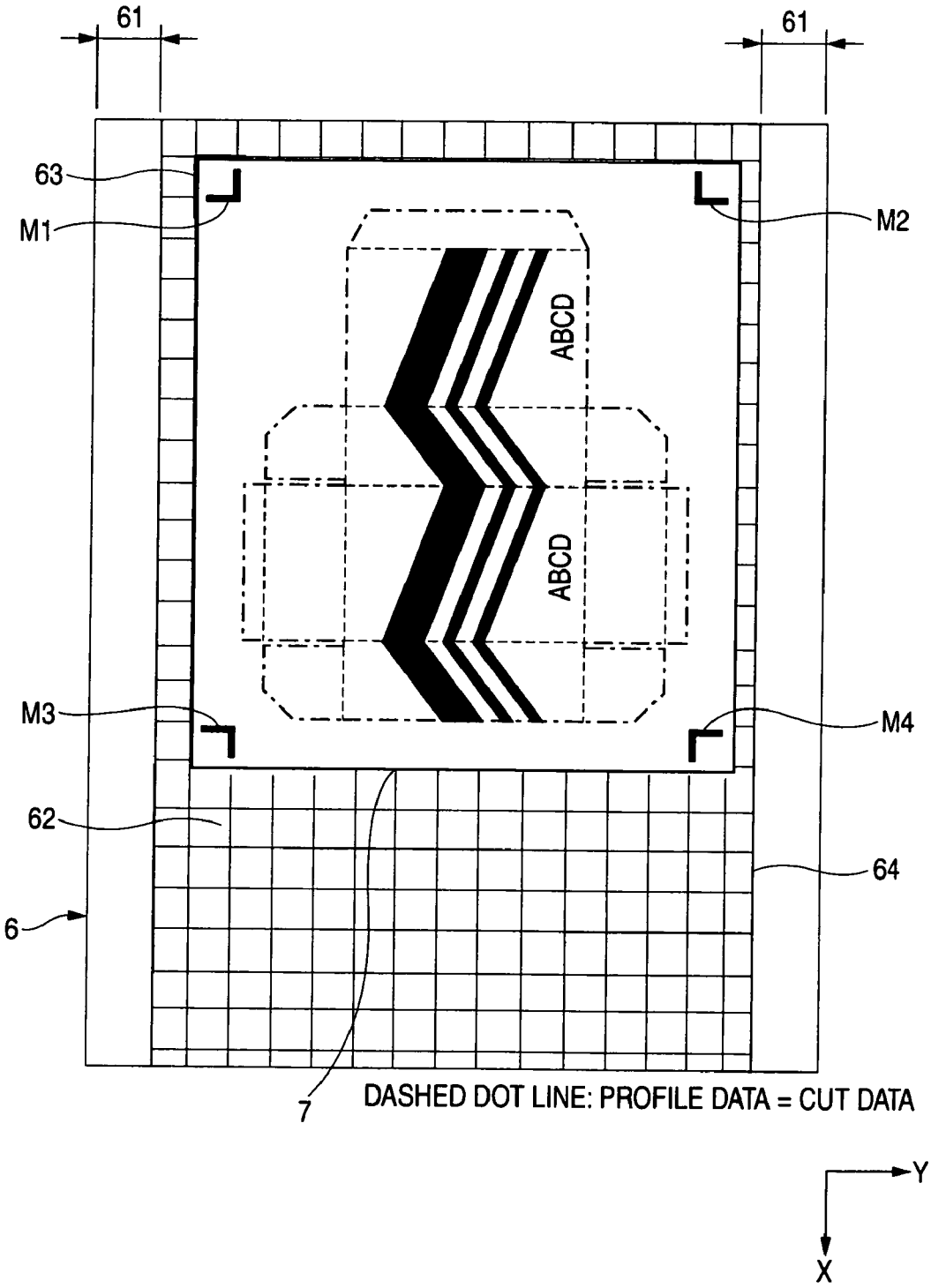
FIG. 5 is a view showing a paper sheet material cut by the cutting plotter of the present invention.

FIG. 5 shows the paper sheet material 7 on which development figures and designs of boxes are previously printed by a printer, etc. For example, figures (development figures), characters, and reference figures, that is, register marks M1 to M4 are printed on the paper sheet material 7.

In the case of cutting the paper sheet material 7 on which the records are formed in advance to manufacture paper products, first, the operator supports the paper sheet material 7 shown in FIG. 5 on the cut target medium supporting sheet 6, similar to the above-mentioned first embodiment. At this time, the paper sheet material 7 is adhered, supported, and fixed to the cut target medium supporting sheet 6 in such a manner that its ends are positioned to be parallel to the graph paper scale 64 so as to coincide with the reference marks 63 and so as not to lean to the cut target medium supporting sheet 6. Further, the paper sheet material 7 is fixed in such a manner that the first reference figure M1 is located around the reference mark, which is the starting point of the cut target medium supporting sheet 6.

Subsequently, both the ends of the cut target medium supporting sheet 6 supporting the paper sheet material 7 are inserted between the driving roller 2 and the pinch roller 3 of the cutting block.

Figure 6A:
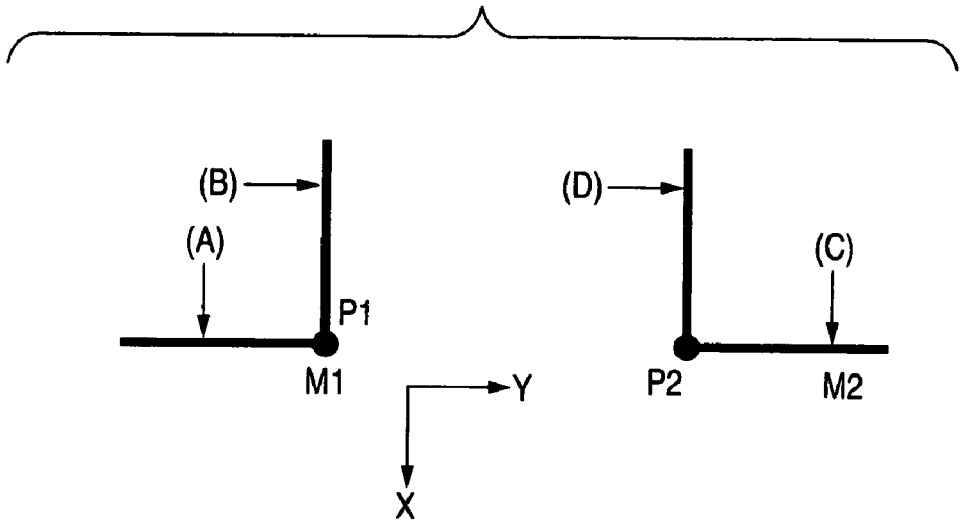
FIGS. 6A and 6B are views showing a reference figure detecting operation by the cutting plotter of the present invention.
Figure 6B:
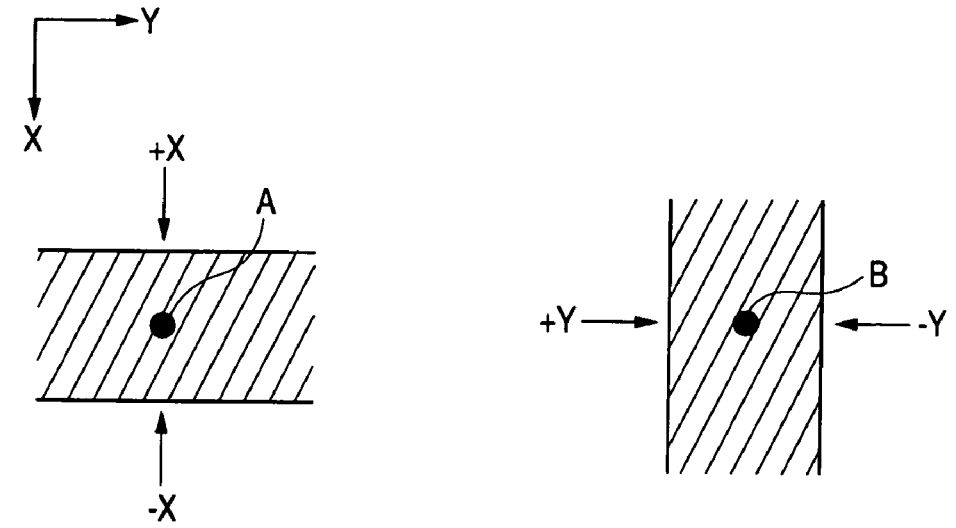

In this cutting plotter, when the cut target medium supporting sheet 6 is set, an operation for detecting the position of the reference figure (register mark) of the paper sheet material 7 is first performed. In other words, in this register mark position detecting operation, the control device 80 controls the X-axis driving control device 82 and the Y-axis driving control device 83, places the pen block 4 in the vicinity of the reference mark 63 serving as the starting point of the cut target medium supporting sheet 6, and detects the first reference figure (register mark) M1 located around the starting point. In the operation of detecting the register mark M1, as shown in FIG. 6B, the control device 80 operates the reading sensor 41 and moves the pen block 4 in the X-axis direction, thereby detecting an upper end of a Y-axis mark line of the register mark M1. When the upper end of the Y-axis mark line of the reference figure M1 is detected, the control device 80 moves the pen block 4 in a positive X-axis direction by a predetermined amount and then moves it in a negative X-axis direction, thereby detecting a lower end of the Y-axis mark line of the reference figure M1. The control device 80 calculates coordinates of a midpoint A between the coordinates of both ends of the X-axis mark line of the detected reference figure M1 and stores them into a recording means as a point on a center line of the Y-axis mark line of the reference figure M. Subsequently, the control device 80 operates the reading sensor 41 to detect right and left ends of an X-axis mark line of the reference figure M1, calculates the coordinates of a midpoint B of both the detected ends (a view on the right side of FIG. 6B), and stores them as a point on the center line of the X-axis mark line of the reference figure M1.

Next, the control device 80 detects upper and lower ends of the Y-axis mark line of the reference figure M2 to calculate the coordinates of a point C on the center line thereof, and then detects right and left ends of the X-axis mark line of the reference figure M2 to calculate the coordinates of a point D on the center line thereof.

By using the coordinates of the points A to D on the center lines of the X-axis and Y-axis mark lines in the two reference figures M1 and M2, the control device 80 calculates intersections P1 and P2 (FIG. 6A) of the X-axis and Y-axis mark lines, which are the reference points of the reference figures M1 and M2. In other words, a perpendicular line is drawn from the point B with respect to straight lines running through the two calculated points A and C, and its intersection becomes the reference point P1 of the reference figure M1. Similarly, a perpendicular line is drawn from the point D with respect to straight lines running through the points A and C, and a coordinate of its intersection P2 becomes the reference point of the reference figure M2. These coordinate values are stored in a storage means. Further, in the same sequence, reference points P3 and P4 of the reference figures M3 and M4 are calculated, and the control device 80 stores and holds these coordinate values.

The control device 80 corrects the cut data transmitted from a host apparatus, such as a computer, on the basis of the coordinate values of the calculated reference points P1 to P4, and controls the X-axis driving control device 82 and the Y-axis driving control device 83 on the basis of the corrected cut data. Then, the control device 80 moves the cut target medium supporting sheet 6 supporting the paper sheet material 7 in the X-axis direction and simultaneously moves the pen block 4 in the Y-axis direction, thereby moving the pen block 4 along a locus corresponding to a profile of a box to be cut that is indicated by a dashed dot line in FIG. 5. The control device 80 simultaneously controls the driving of the Z-axis driving control device 84 to selectively go down the cutting pen 5, thereby bringing the cutting pen into press contact with the paper sheet material 7 to cut the paper sheet material 7.

With this configuration, according to the present invention, it is possible to exactly match that profile with the previously formed record and then to cut the paper sheet material 7.

Next, a description will be made about a case in which the paper sheet material is cut on the basis of an image file as the cut data by means of the cutting plotter of the present invention.

As described above, in the case in which a figure is printed on the paper sheet material 7 in advance by means of a printer and the outline of the printed figure is cut by means of the cutting plotter, it is troublesome to carry out a work for generating additional cut data corresponding to the figure data. For this reason, it is preferable that cut data be included in the recorded figure data in advance.

As this type of image file, for example, image files made up of general-purpose data formats of EMF, WMF, EPS, etc., may be used. These image files are composed of a set of information called a plurality of objects, such as 'points,' 'lines,' 'surfaces,' and 'characters'. For each of the objects, for example, in the case of 'line' data, attributes, such as a line type, a line width, and a line color, are individually provided. These image files are generated by various types of application software, but are adapted to have generality by standardizing the description of their attributes in a fixed format so as to be processed by other applications.

Further, in the present embodiment, when generating image data, the image data is described as the object having specific attributes with respect to cut lines to be cut, and is generated as one image data together with the recorded figure data to be printed by a printer. In addition, the paper sheet material is adapted to be cut on the basis of the image data when the cutting operation is performed by the cutting plotter.

FIGS. 7A to 7D are views showing a configuration of this image file. In FIGS. 7A to 7D, one image file is composed of a header section and a plurality of object data, such as a line 1, a surface 1, a character 1, a line 2, . . . . For instance, the data to be cut by the cutting plotter is defined as attributes of 'line type dashed dot line, line color R249, G250, and B250, and line width 0.1 mm±0.02 mm or ¼ point,' and in the application software for generating the image data and the cut data, vector data of outlines as the cut data to be cut together with the recorded figure data to be printed are described as an object having these attributes.

Figure 8:
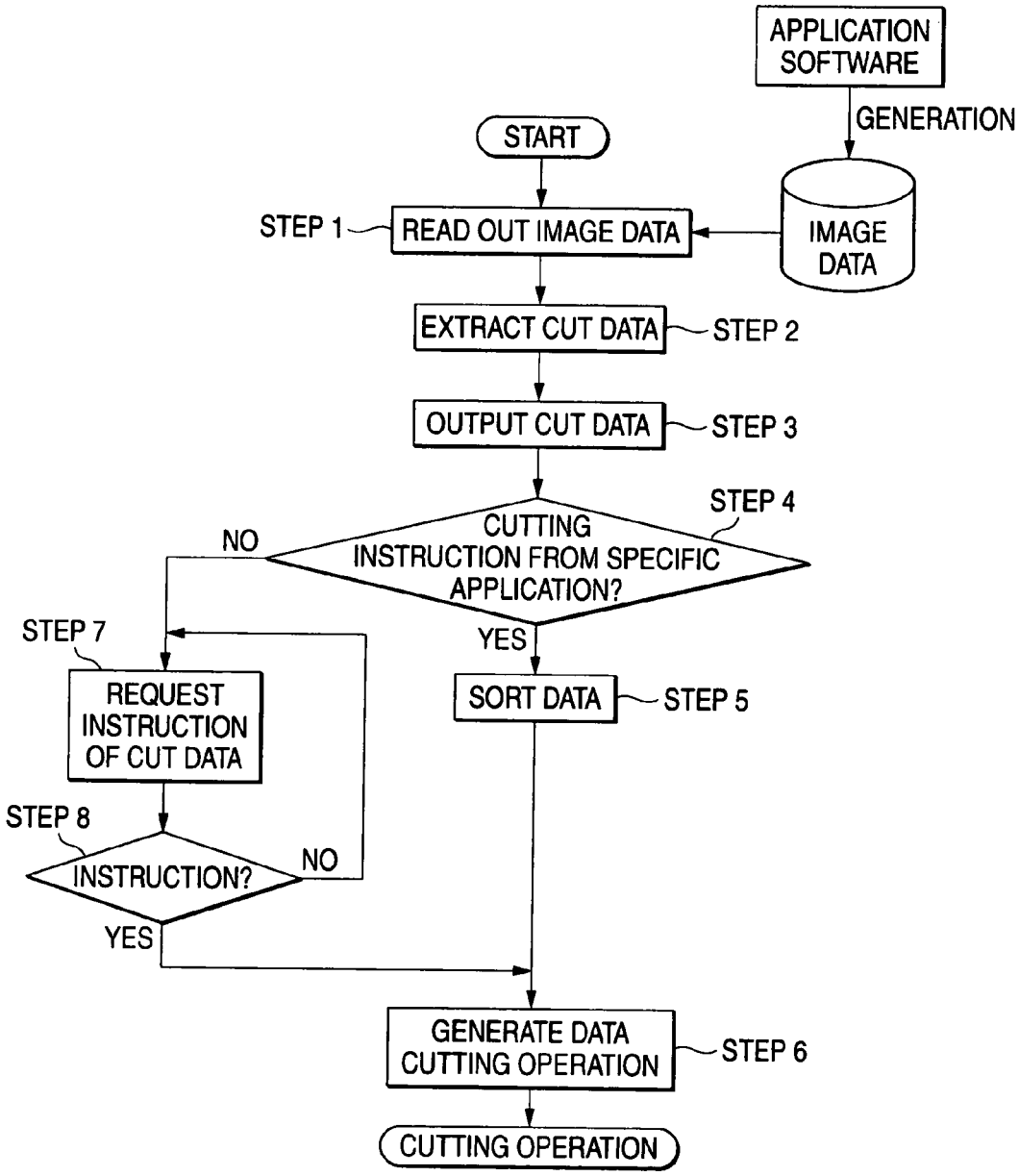
FIG. 8 is a view showing a cutting operation of the cutting plotter of the present invention.

FIG. 8 is a flow chart showing an operation method in the case in which the cutting plotter performs cutting in the present embodiment, wherein to actually perform this operation is a program for controlling the driving of the cutting plotter in response to cutting instructions from each application software dealing with image file data.

When a cutting instruction from each application software dealing with the image file data is detected, first, target image data is read out (STEP 1).

Next, the process proceeds to STEP 2, and the application software generating the image data related to cutting detects data described with predetermined attributes that are previously defined as data for cutting. Specifically, only vector data is extracted from the image data first, and the attributes of the image data are each detected again, and thereby cutting purpose vector data are extracted (FIG. 7C)

Subsequently, the process proceeds to STEP 3, and the cutting purpose data are outputted to a driver. In the driver, it is detected whether the application software having output the data belongs to predetermined application software or not (STEP 4). In other words, the cutting purpose data of the present embodiment is outputted as general purpose vector data. For this reason, there is a possibility that a vector not to be cut will be present in the data outputted from general application software. In that case, there is a fear that a place not to be cut will be cut. In order to avoid this, it is detected whether to be the application where the image data is generated under the above-mentioned condition. For the actual detection operation, a document name of the data is generated in a predetermined form when outputting the data in STEP 3, and the document name is then detected in STEP 4.

Figures 7A, 7B, 7C, 7D:
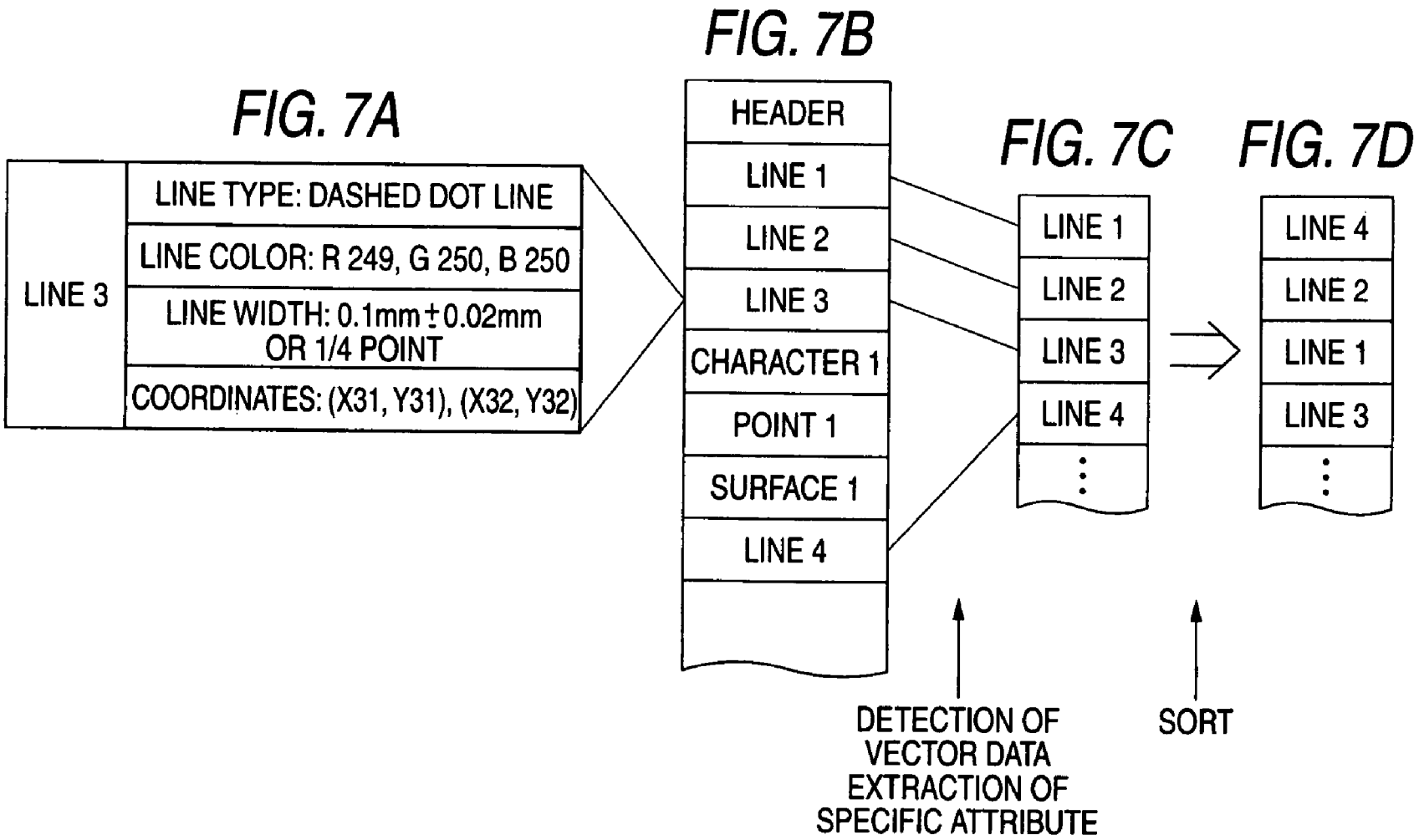
FIGS. 7A to 7D are views showing image data of the cutting plotter of the present invention.

Then, the process proceeds to STEP 5, and these data are sorted with reference to the coordinates of a cutting start point and a cutting end point of the extracted vector data to be cut (FIG. 7D). Thereby, the movement distance of the cutting pen (an operation of separating the cutting pen 5 serving as the cutting means from the cut target medium and of moving the cutting pen by means of the cut data) in the cutting operation can be shortened, so that it is possible to shorten the cutting time. The sorted vector data is used as the cut data (STEP 6), and the cutting operation is performed on the basis of the generated cut data.

In STEP 4, when the cutting instruction is determined not to be outputted from the specific application software, the process proceeds to STEP 7, and an order to instruct which object of the cut data, namely, the image data should be cut is given to the order. At the point of time when the instruction is completely given to the operator, the process proceeds to STEP 6. Then, the cutting operation is performed by using the instruction as the cut data.

In this manner, the type of the application software generating the image data is determined. As a result, when the vector data having predetermined attributes are present, it is possible to detect whether the vector data is one to be cut or to be recorded.

As such, according to the present invention, the cut data can be described as an object of one of the general purpose data files, so that it is possible to improve the convenience of data usage and to perform cutting by the cutting plotter and recording by a printer, using one image data.

Set values for the conditions of the cutting operation, such as a drawing speed, acceleration, writing pressure, and offset compensation amount, corresponding to the type of the cut target medium to be cut are individually stored and held in the storage means. The operator selects a cut target medium to be cut by the cutting plotter before the cutting operation and set it. In this case, the cutting plotter reads out the corresponding setting conditions from the storage means according to the type of the selected cut target medium and performs the cutting operation on the basis of the setting conditions. Further, the setting conditions include information on the cutting means, and among the setting conditions read from the storage means, the information on the cutting means is displayed by a display means.

[Fifth Embodiment]

Figure 9:
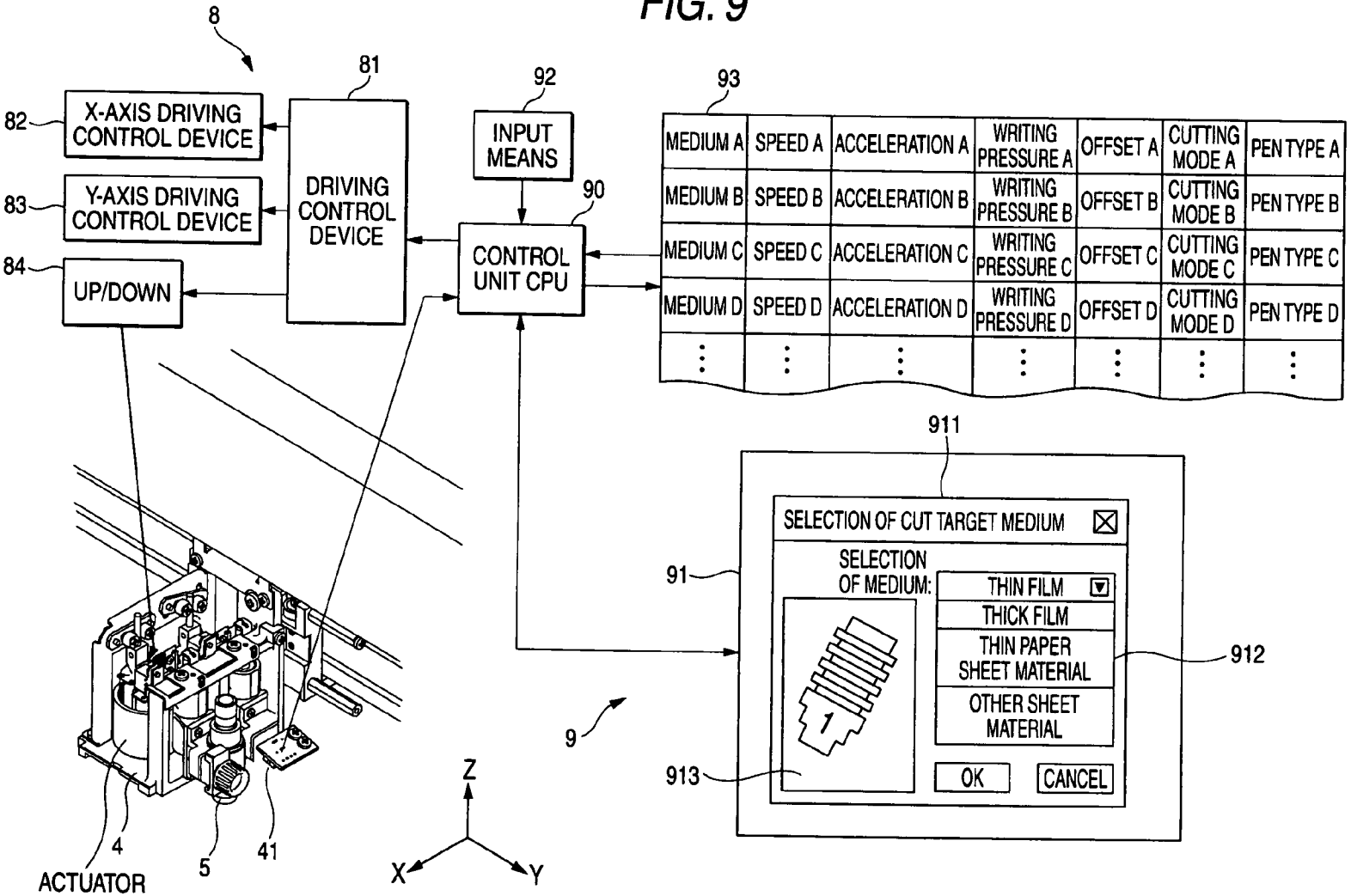
FIG. 9 is a block diagram showing a configuration of the cutting plotter of the present invention.

FIG. 9 is a functional block diagram showing a configuration of a medium driving type cutting plotter of the present invention. In FIG. 9, reference numeral 7 indicates a driving control device for controlling the driving of the cutting plotter, and reference numeral 9 indicates a computer serving as a host apparatus for issuing various demands (commands), such as a cutting demand, to the cutting plotter. In the present embodiment, the computer is exemplified as the host apparatus, but any apparatus capable of transmitting various commands for a cutting operation to the cutting plotter, such as a work station or a dedicated controller provided in a main body of the cutting plotter will be used. The driving control unit 8 includes the X-axis driving control device 82 for controlling a driving motor which rotates a driving roller 2 in a forward or backward direction to drive a sheet type medium 7, which is a cut target medium in the X-axis direction, the Y-axis driving control device 83 for controlling the pen block 4 to move in the Y-axis direction, the Z-axis driving control device 84 for controlling the driving of an actuator which brings a cutting pen 5 into press contact with and separates it from the sheet type medium 7, and the control device 81 for performing various controls on the respective driving control devices.

In the case in which the sheet type medium is cut in a desired shape by means of the medium driving type cutting plotter, both ends of the sheet type medium 7 are inserted between the driving roller 2 and a pinch roller 3, and then the control device allows the cutting pen 5 to be brought into press contact with or separated from the sheet type medium 7 by the actuator of the pen block 4 on the basis of cut data transmitted from the host apparatus 9, and moves the pen block 4 holding the cutting pen 5 in the Y-axis direction and simultaneously rotates the driving roller 2, thereby moving the sheet type medium 7 in the X-axis direction. In this way, the cutting pen 5 moves in the two-dimensional direction relative to the sheet type medium 7 on the basis of the cut data, and thus the sheet type medium 7 is cut.

Further, reference number 9 indicates the computer serving as a host apparatus for transmitting commands, such as a cutting command, to the cutting plotter. In the drawing, reference numeral 90 indicates a control unit for performing various controls, reference numeral 91 indicates a display means, such as a monitor, reference numeral 92 indicates an input means for performs the input of various commands and instruction, such as a mouse or a keyboard, and reference numeral 93 indicates a storage means in which various setting conditions are stored and held.

In the cutting plotter of the present invention, operational conditions, such as pen speed, acceleration, writing pressure, offset compensation amount, a cutting operation mode, and pen type as information on a cutting means which is optimal to carry out cutting, according to the type of the cut target medium to be cut are individually stored and held in the storage means 93. In these operational conditions, the 'pen speed' is a parameter for determining the movement speed of the cutting pen, the 'acceleration' is a parameter for determining the movement acceleration of the cutting pen, the 'writing pressure' is a parameter for determining the compression pressure of the cutting pen on the sheet type medium, and the 'offset compensation amount' is a parameter for determining the coordinate compensation amount at the time of the start of cutting. To be specific, the speed and acceleration refer to the number of driving timing pulses per unit time transmitted from the X-axis and Y-axis driving control devices 82 and 83 to each driving motor. The writing pressure refers to a control command, such as a current value, given to the actuator of the pen block 4 transmitted to the Z-axis driving control device 84. Further, the offset compensation amount refers to a compensation value given to the coordinates of a cutting start point in the cut data. The speed and acceleration of the pen are involved in the precision of, particularly, a cut target figure to be drawn. When a slim figure is drawn, these values are preferably set to be small. Further, the writing pressure is involved in the type of a medium to be cut. When the medium is great in thickness and stiffness, it is preferably set to be great. Further, the 'cutting operation mode' is a cutting operation program corresponding to the type of a medium for allowing the cutting means to move plural times between a start point and an end point with respect to a unit segment of a line in the cut data to perform cutting, as disclosed in JP-A-2003-220594, when a medium to be cut is made of an elastic material or a thick or solid material, and the 'cutting operation mode' is stored and held in the storage means 93 composed of a storage table as a control command, similar to the above-mentioned operational conditions. Further, the information on the "pen type" refers to the type of the cutting pen having the optimal blade projection amount with respect to the cut target medium to be cut. As the operational condition, the optimal type of the cutting pen corresponding to the type of the medium is stored and held in the storage means 93.

These cutting condition setting values are stored and held in the storage means 93 according to the type of the medium to be cut as shown in the drawing. In the cutting plotter of the present invention, a combination of the various setting conditions corresponds to the type of the medium, and an optimal value of each parameter is previously stored. These optimal values can be set only by selecting the type of the medium to be cut by the operator.

In the setting operation of the cutting conditions, the control unit 90 allows the display means 91 to display a 'cut target medium selecting window' 911 for setting various cutting operation conditions. The cut target medium selecting window 911 has a medium type selection and display window 912 for displaying a medium type list previously stored in the storage means 93 and a pen type display window 913 for displaying information on a pen type among setting means corresponding to the type of the selected medium.

The operator manipulates the input means 92 while viewing the cut target medium selection window 911 to select the type of the medium to be cut on the medium type selection and display window 912. Here, when the medium to be cut is selected, the control unit 90 reads out the cutting conditions for the selected medium from the data in the storage means 93, and displays the type of the (optimal) cutting pen 5 corresponding to the selected medium on the pen type display window 913 of the display means 91, based on the information on the pen type among the cutting conditions. The operator confirms the display of the pen type display window 913 to select the optimal cutting pen 5 corresponding to the sheet type medium 7, and mounts the selected cutting pen to the pen block 4. After this operation, the operator clicks an 'OK' button on the cut target medium selection window 911 or pushes an execution key on a keyboard, thereby completing the cutting condition setting operation. When the setting of the cutting conditions is completed, the control unit 90 moves the pen block 4 to which the cutting pen 5 is mounted in the two-dimensional direction relative to the sheet type medium 7 (the X-axis and Y-axis driving devices) and allows the cutting pen 5 supported on the pen block 4 to be brought into press contact with and separated from the sheet type medium 7 (the Z-axis driving device), thereby cutting the sheet type medium.

In this manner, in the cutting plotter of the present invention, the operator can set various optimal setting conditions for a medium to be cut in an easy and exact manner only by selecting the type of the medium to be cut.

[Sixth Embodiment]

In the above-mentioned embodiment, various conditions are set by the operator selecting the type of the medium 7 to be cut. However, the type of the medium 7 to be cut may be detected by previously inscribing marks denoting the type of a medium, such as bar codes, on the surface of the sheet type medium 7 and by reading the marks using the sensor unit 41 provided to the pen block 4 shown in FIG. 9, and set values corresponding to the type of the detected medium may be read out from the storage means 93.

In this embodiment, the medium type detecting operation is performed after the sheet type medium 7 is set to the main body 1 of the cutting plotter and before the cutting operation is performed. In this medium type detecting operation, the driving control device 81 controls the X-axis and Y-axis driving control devices 82 and 83 to allow the pen block 4 to pass through the marks formed on the sheet type medium 7. At that time, the driving control device 81 operates the sensor unit 41 to read the marks, and the control unit 90 of the host apparatus 9 sets cutting conditions by detecting the type of the set medium 7 based on the output from the sensor section 41, and by reading out operational conditions corresponding the detected medium type from the storage means 93.

According to this embodiment, the medium type setting operation performed by the operator is not needed, and it is possible to easily set various operational conditions.

The position of the cut target medium supported on the main body of the cutting plotter and a region in which the reference mark formed on the cut target medium is included are specified from a preset operational starting point of the cutting means and a relative coordinate value (distance) of the positioning mark provided to the cutting plotter that is used when supporting the cut target medium, and the reading sensor is moved along a preset locus in this region to detect the reference mark.

[Seventh Embodiment]

Figure 10:
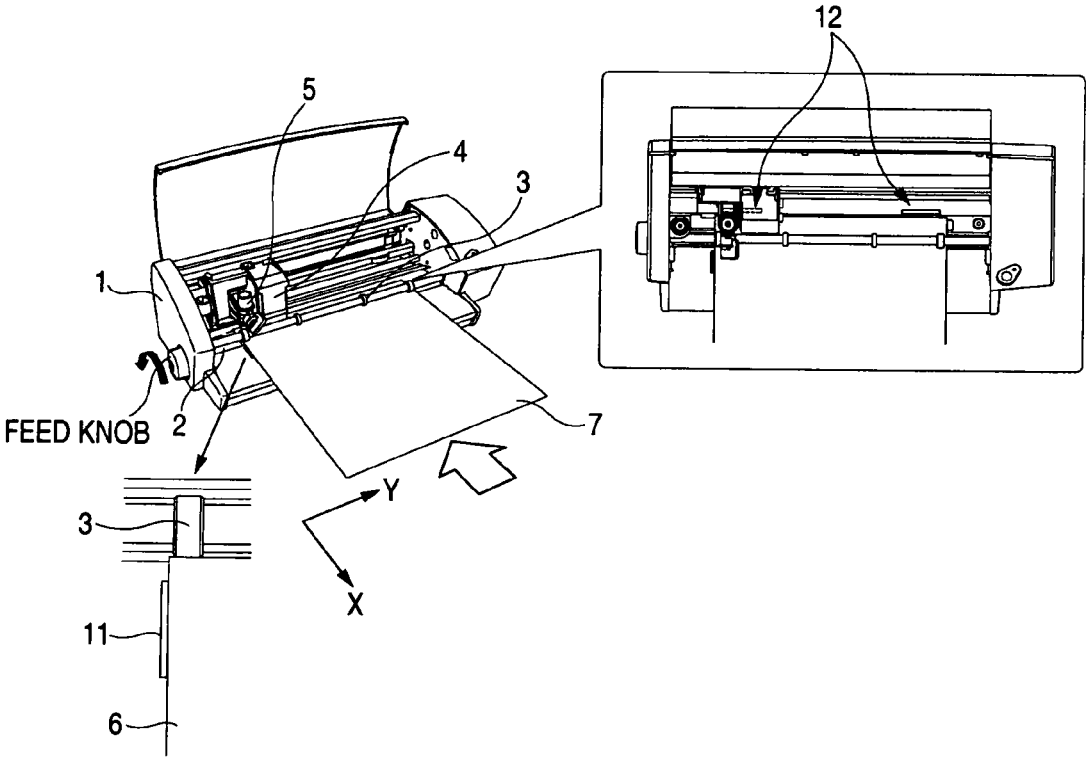
FIG. 10 is a view showing a configuration of the cutting plotter of the present invention.

FIG. 10 is a view showing a configuration of a cut target medium driving type cutting plotter, which is an example of the cutting plotter according to the present invention. In FIG. 10, reference numeral 1 indicates a main body of the cutting plotter, reference numeral 2 indicates a driving roller, reference numeral 3 indicates a pinch roller, reference numeral 4 indicates a pen block, reference numeral 5 indicates a cutting pen, and reference numeral 7 indicates a paper sheet material serving as a cut target medium.

In the cutting plotter, both end portions of the sheet material 7 serving as the cut target medium are interposed between the driving roller 2 receiving forward or backward rotation driving force generated by a driving motor and the pinch roller 3 pressed against the driving roller, and the sheet material 7 is driven in the X-axis direction of the drawing by the rotation of the driving roller 2. The pen block 4 is provided to be movable on the main body 1 of the cutting plotter in the Y-axis direction of the drawing by a movement mechanism (not shown). Further, the pen block 4 holds the cutting pen 5, serving as a cutting means, and is provided to allow the held cutting pen 5 to be brought into press contact with and separated from the cut target medium 7 by the descent and ascent by an actuator (not shown).

A control device controls the driving of the driving roller 2 on the basis of cut data for the shape of a target to be cut to move the cut target medium 7 in the X-axis direction of the drawing, such that the pen block 4 is moved in the Y-axis direction and the cutting pen 5 is moved in the two-dimensional direction relative to the paper sheet material 7. Further, the control device allows the cutting pen 5 to be selectively brought into press contact with and separated from the paper sheet material 7, thereby cutting the paper sheet material in a desired shape.

Further, as shown in FIG. 10, the main body 1 of the cutting plotter is provided with an X-axis guideline 11 and a Y-axis guideline 12 for positioning the cut target medium 7 when supporting the cut target medium 7.

Figure 11:
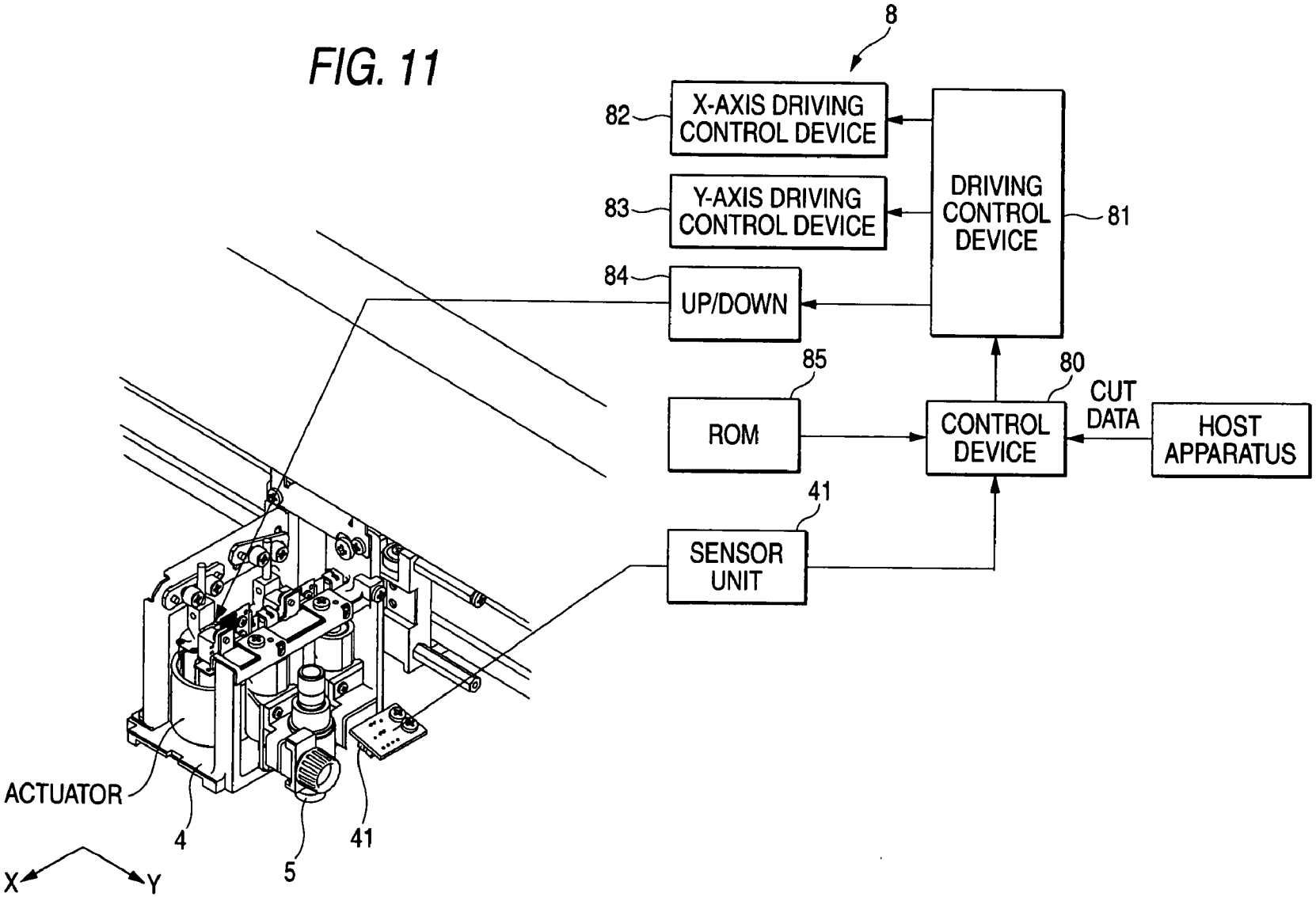
FIG. 11 is a block diagram showing a configuration of the cutting plotter of the present invention.

FIG. 11 is a functional block diagram showing a configuration of the medium driving type cutting plotter. In FIG. 11, reference numeral 8 indicates a control unit for performing various kinds of controls, and the control unit is composed of a control device 80 for generating cut data for the cutting pen 5 on the basis of cut data or record data transmitted from a host apparatus, such as a computer, and a driving controller 81 for controlling the driving of each of an X-axis driving control device 82, a Y-axis driving control device 83, and a Z-axis driving control device 84 on the basis of the cut data transmitted from the control device 80. The X-axis driving control device 82 controls the driving of a driving motor which rotates the driving roller 2 in a forward or backward direction. The Y-axis driving control device 83 controls the driving of a driving motor which moves the pen block 4 in the Y-axis direction. The Z-axis driving control device 84 controls driving of an actuator which brings the cutting pen 5 into press contact with and separates it from the paper sheet material 7. The pen block 4 is provided with a reference mark reading sensor 41 for detecting a reference mark, and the reference mark reading sensor 41 is composed of a reflective photo sensor and detects the coordinates of a reference figure on the X-axis and Y-axis to transmit reference mark data to the control device 80.

Figure 12:
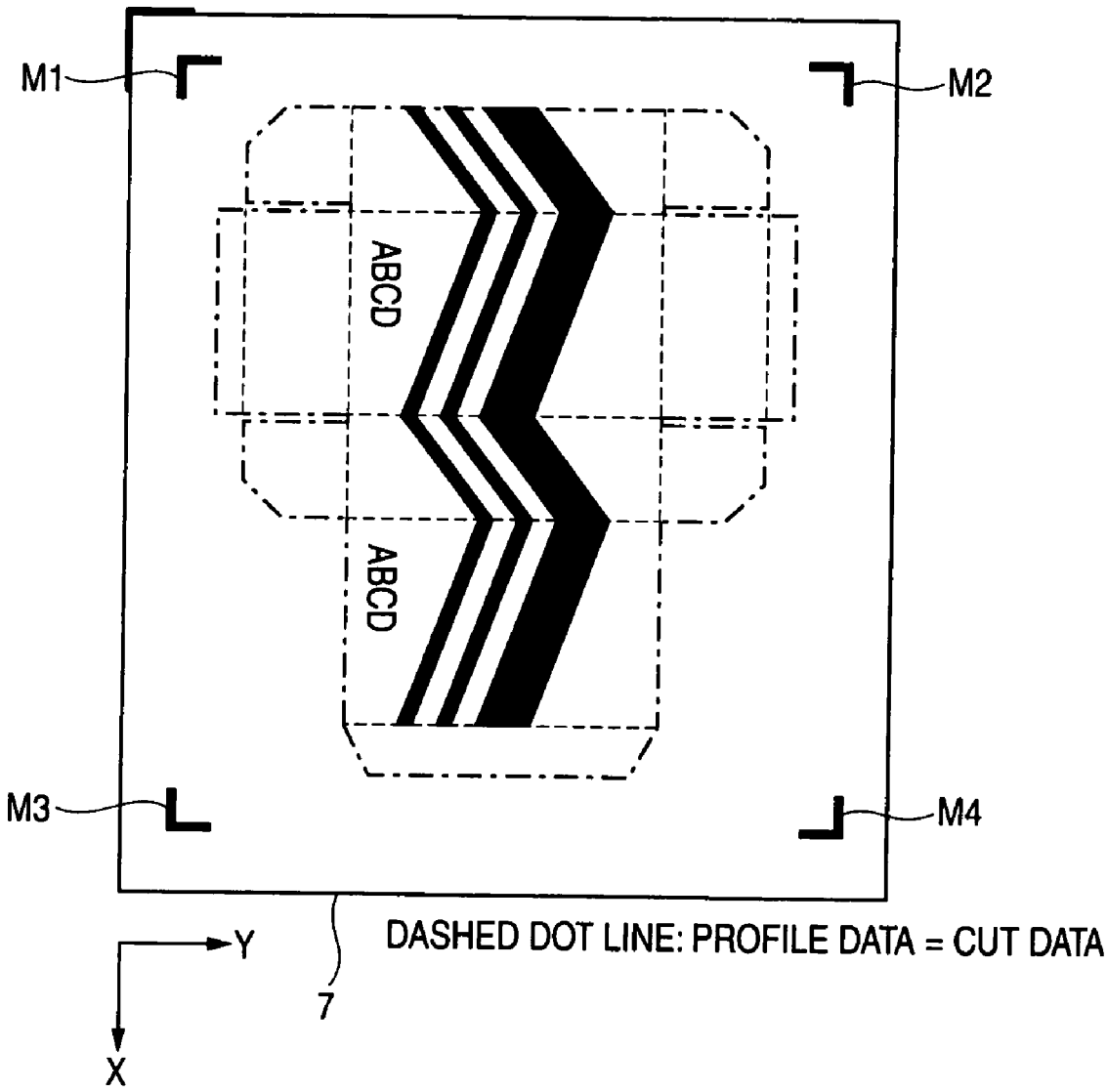
FIG. 12 is a view showing the paper sheet material cut by the cutting plotter of the present invention.

FIG. 12 shows a paper sheet material 7 on which development figures and designs of boxes are previously printed by, for example, a printer. For instance, figures (development figures), characters, and reference marks for matching the profiles of the figures with the cut data by the cutting plotter, that is, register marks M1 to M4 are recorded on the paper sheet material 7.

Subsequently, an operation of cutting the outline of a figure recorded on the paper sheet material using the cutting plotter of the present invention will be described below.

(1) Supporting Cut Target Medium

In the case in which the paper sheet material 7 is cut in a desired shape by means of the medium driving type cutting plotter, first, an operator supports the paper sheet material 7 to be cut on the main body 1 of the cutting plotter.

At this time, as shown in FIG. 10, the paper sheet material 7 is placed with its end on an X-axis side matched with the X-axis guide line provided to the main body 1 of the cutting plotter, and brings its end (leading end) on an Y-axis side into contact with the pinch roller 3. Since the pinch roller 3 is pressed against the driving roller 2, the Y-axis end of the paper sheet material 7 is exactly matched with the Y-axis of the cutting plotter. In this state, the operator turns a feed knob provided on a transverse side of the main body 1 of the cutting plotter to rotate the driving roller 2 and the pinch roller 3 pressed against the driving roller, thereby inserting the paper sheet material 7 between the driving roller 2 and the pinch roller 3. Further, the operator turns the feed knob to carry the paper sheet material 7 such that the Y-axis side end coincides with the Y-axis guideline 12. Then, the supporting of the paper sheet material 7 to the main body 1 of the cutting plotter is completed.

The X-axis guideline 11 and the Y-axis guideline 12 provided to the main body 1 of the cutting plotter are matched with the movement directions of the cutting pen 5 (the pen block 4), serving as a cutting means, and the cut target medium 7 (the driving roller 2), that is, with the X-axis and the Y-axis on the two-dimensional plane in which the cutting means moves relatively to the cut target medium. Hence, the paper sheet material 7, serving as a cut target medium, is supported to be match with the X-axis and Y-axes guidelines 11 and 12. Therefore, it is possible to match the paper sheet material 7 with the X and Y coordinate axes in the two-dimensional plane where the cutting means 5 moves.

(2) Initial Operation

When the supporting of the paper sheet material 7 is completed, the cutting pen 5 (the pen block 4) returns to an operation starting point, that is, an initial operation is performed. In the initial operation, the driving controller 81 drives the Y-axis driving control device 83 to move the pen block 4 in the Y-axis direction of the drawing and stops the pen block 4 at a point of time where the pen block 4 is detected by a detecting sensor (not shown) provided within the movable range of the pen block 4. Then, the driving controller 81 moves the pen block 4 in the reverse direction and counts a movement amount at that time, i.e., the number of pulses outputted from the driving motor, thereby locating the pen block 4 at the operation starting point. In this state, the cutting plotter becomes a standby state.

(3) Detecting Approximate Position of Reference Mark

Next, the approximate position of the reference mark that has been already recorded on the paper sheet material 7 is detected.

In the cutting plotter of the present invention, the reference mark recorded on the cut target medium or a region where a so-called register mark is recorded is detected based on the operation starting point of the cutting pen 5 which is set by the initial operation, the supporting position of the cut target medium which is set by the X-axis and Y-axis guidelines, and the record data formed on the cut target medium, and then the accurate position of the first register mark in the detected region is detected. Then, the positions of the second and third (fourth) register marks are detected by the position of the detected first register mark and the record data recorded on the cut target medium, and cut data for cutting is corrected using the detected register mark data.

Figure 13:
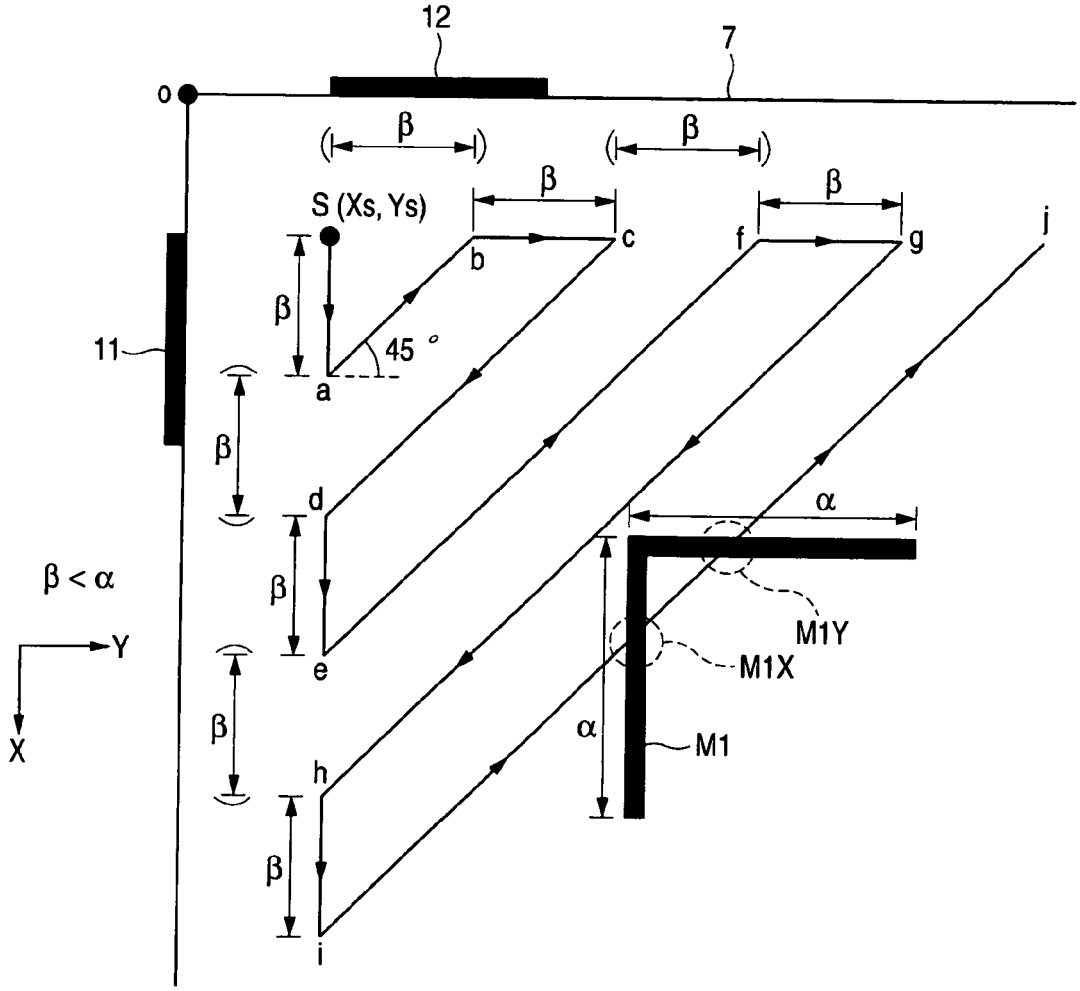
FIG. 13 is a view showing the reference figure detecting operation by the cutting plotter of the present invention.
Figure 14:
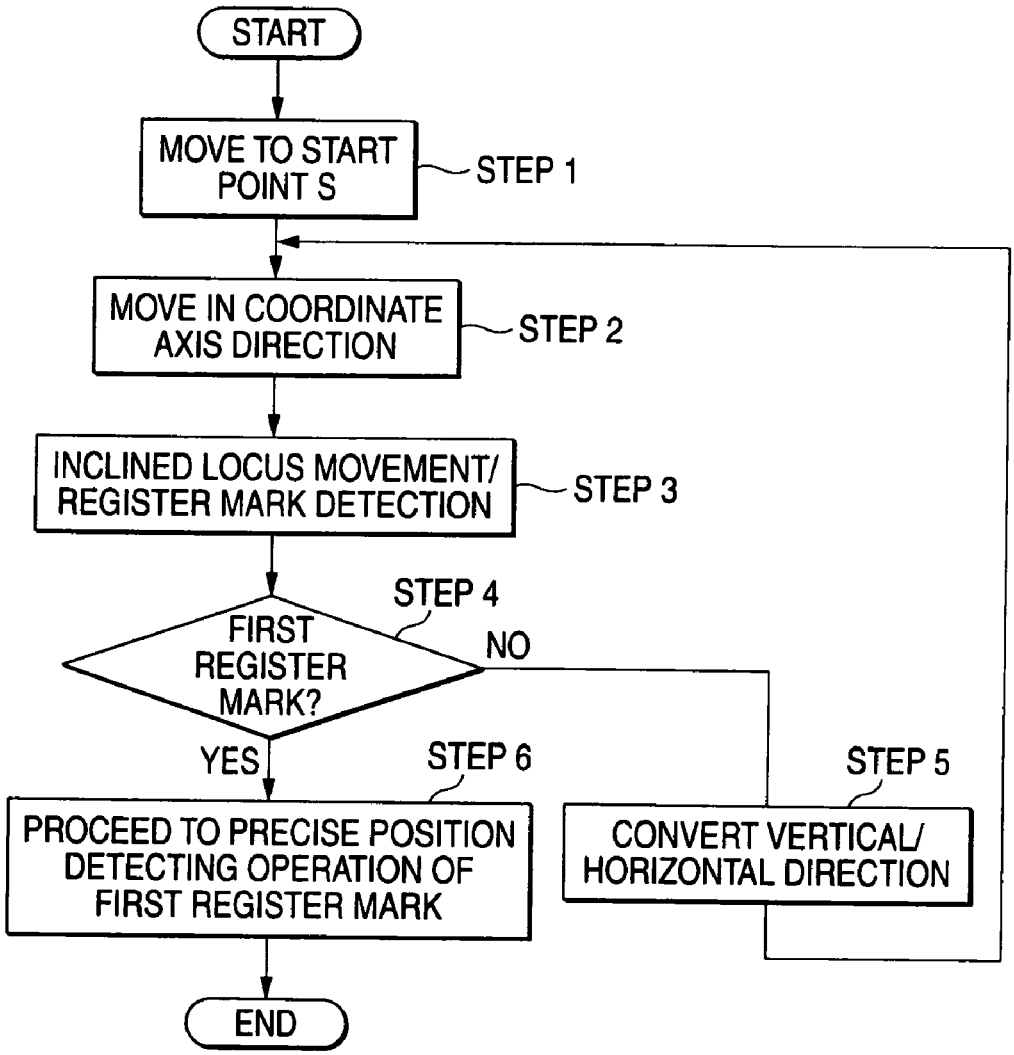
FIG. 14 is a view showing the image data of the cutting plotter of the present invention.

FIGS. 13 and 14 are an explanatory diagram and a flow chart illustrating the operation of detecting the approximate position of a reference mark, respectively. In the operation of detecting the approximate position of the reference mark, first, the control device 80 controls the X-axis and Y-axis driving control devices 82 and 83 to position the reference mark reading sensor 41 at a reading start point S (Xs, Ys) (STEP 1).

The position of the reading start point S (Xs, Ys) is set in a blank space between end portions of the X-axis and Y-axis sides of the cut target medium 7, that is, between an intersection (O in FIG. 13) of the extending X and Y-axis guidelines 11 and 12 and the first register mark M1.

For application software for performing recording on the cut target medium 7, the positions of the register marks M1 to M4, that is, distances from the end portions of the cut target medium 7 are always maintained as fixed values in advance, and the shapes (length $\alpha$) of the register marks M1 to M4 are previously set as predetermined values, so that the record data and the cut data are placed in a region surrounded by the register marks M1 and M4. Further, blanks are provided to the first register mark M1 and the end portions of a sheet in the X and Y-axis directions.

Subsequently, the control device 80 controls the X-axis and Y-axis driving control devices 82 and 83 to move the reference mark reading sensor 41 to a point a (Xs+$\beta$, Ys) separated from the reading start point S (Xs, Ys) in the X-axis direction by a predetermined distance $\beta$ (the predetermined distance $\beta$ is a value smaller than the length $\alpha$ of each of the register marks M1 to M4) (STEP 2).

The control device 80 controls the X-axis and Y-axis driving control devices 82 and 83 to move the reference mark reading sensor 41 along a locus forming an angle of 45 degrees from the point a in the Y-axis direction, and monitors the output of the reference mark reading sensor 41 (STEP 3) to detect whether the first register mark M1 exists on the cut target medium 7 or not (STEP 4).

When the reference mark reading sensor 41 arrives at a point b(Xs, Ys+$\beta$) having the same X coordinate value as the start point S due to the movement in STEP 3, and in the meantime, the first register mark M1 is not detected from the output of the reference mark reading sensor 41, the process proceeds to STEP 5. The control device 80 sets the X-axis and Y-axis driving control devices 82 and 83 to change the movement of the coordinate axis direction in STEP 2 from the X-axis direction to the Y-axis direction as well as the movement locus of the coordinate axis direction in STEP 3 from the Y-axis direction to the X-axis direction in a direction forming the angle of 45 degrees, and then returns to STEP 2. When returning to STEP 2, the control device 80 controls the driving of the X-axis and Y-axis driving control devices 82 and 83 to move the reference mark reading sensor 41 in the Y-axis direction from the point b to a point c (Xs, Ys+2$\beta$) which is separated form the point b by the predetermined distance $\beta$, and the process proceeds to STEP 3. The control device 80 controls the driving of the X-axis and Y-axis driving control devices 82 and 83 to move the reference mark reading sensor 41 along a locus forming an angle of 45 degrees from the point c in the X coordinate axis direction, and monitors the output of the reference mark reading sensor 41 to detect whether the first register mark M1 exists on the cut target medium 7 or not (STEP 4).

When the reference mark reading sensor 41 arrives at a point d (Xs+2$\beta$, Ys) having the same Y coordinate value as the start point S due to the movement in STEP 3, and in the meantime, the first register mark M1 is not detected from the output of the reference mark reading sensor 41, the process proceeds to STEP 5. The control device 80 controls the X-axis and Y-axis driving control devices 82 and 83 to change the movement of the coordinate axis direction in STEP 2 from the Y-axis direction to the X-axis direction as well as the movement locus of the coordinate axis direction in STEP 3 from the X-axis direction to the Y-axis direction in a direction forming the angle of 45 degrees, and then returns to STEP 2. Then, the movement of the reference mark reading sensor in the X(Y) coordinate axis direction (STEP 2), the movement of the reference mark reading sensor along a locus forming the angle of 45 degrees in the Y(X) coordinate axis direction (STEP 3), and the detection of the first register mark M1 (STEP 4) are performed sequentially.

When the first register mark M1 on the cut target medium 7 is detected in STEP 4, the reference mark reading sensor 41 outputs a result of 'existence of the register mark' on a coordinate point M1X of the first register mark M1 in the X coordinate axis direction and a coordinate point M1Y of the first register mark M1 in the Y coordinate axis direction when moving from a point i to a point j in an example of the drawing. When this is detected, the control device 80 proceeds to STEP 6 to terminate the operation of detecting the approximate position of the reference mark, and then proceeds to the next operation of detecting the approximate position of the reference mark.

(4) Detecting Accurate Position of Reference Mark

Figure 15A:
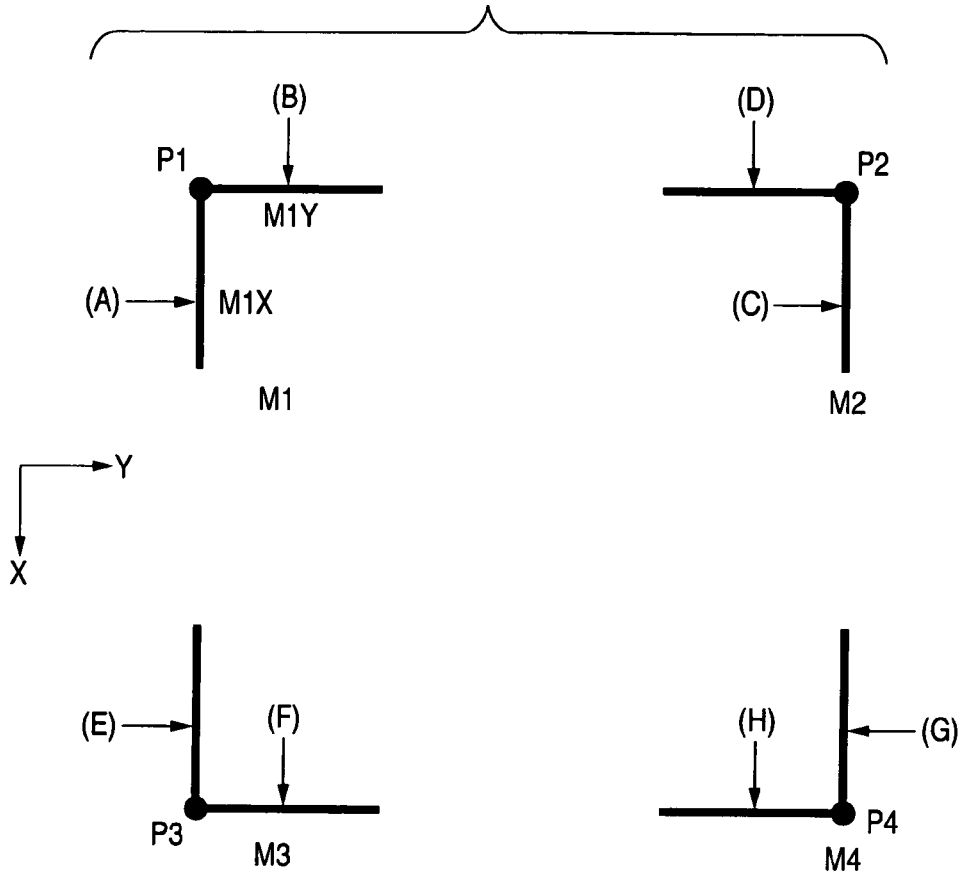
Figure 15B:
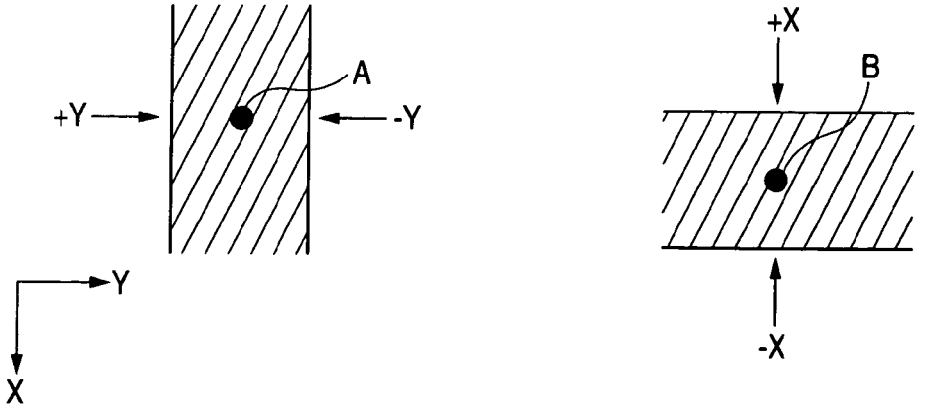

In the operation of detecting the accurate position of the reference mark, first, the control device 80 controls the X-axis and Y-axis driving control devices 82 and 83 to locate the reference mark reading sensor 41 around the point M1X using the coordinate points M1X and M1Y which denote the reference mark M1, which is the first register mark, detected in the operation of detecting the approximate position of the reference mark, and moves the sensor 41 in a negative Y-axis direction by a predetermined amount as shown on the left side of FIG. 15B. Then, the control device 80 reverses the direction into the positive Y-axis direction and monitors the output of the sensor to detect the coordinates of a left end of an X-axis mark line of the reference figure M1. The control device 80 moves the sensor in the positive Y-axis direction to completely pass the sensor on the X-axis mark line and reveres the direction of the sensor into the negative Y-axis direction to detect the coordinates of a right end of an X-axis mark line of the reference figure M1. The control device 80 calculates the coordinates of a midpoint A between the coordinates of both ends of the X-axis mark line of the detected register mark M1 and stores it as a point on a center line of the X-axis mark line of the register mark M1.

Subsequently, the control device 80 controls the X-axis and Y-axis driving control devices 82 and 83 to locate the reference mark reading sensor 41 around the point M1Y detected in the operation of detecting the approximate position of the reference mark, moves again the sensor 41 in the negative X-axis direction by a predetermined amount as shown on the right side of FIG. 15B, reverses the negative X-axis direction to move the sensor in the positive X-axis direction, detects the coordinates of an upper end of a Y-axis mark line of the reference figure M1 from the output of the sensor, and again moves the sensor in the positive X-axis direction to completely pass the sensor on the Y-axis mark line, reveres the positive X-axis direction once more to move the sensor in the negative X-axis direction, and detects the coordinates of a lower end of an Y-axis mark line of the reference figure M1. The control device 80 calculates the coordinates of a midpoint B between coordinates of both ends of the Y-axis mark line of the detected register mark M1, and stores the calculated coordinate value, as a point on the center line of the Y-axis mark line of the register mark M1, in the storage means.

Then, the control device 80 calculates the approximate position of the second register mark M2 from the coordinate values of M1X and M1Y detected in the operation of detecting the approximate position and from the record data which is generated by a host apparatus, such as a computer, and is recorded on the cut target medium 7 and moves the reading sensor 41 around the approximate position of the second register mark M2 to detect the accurate position of the second register mark M2. In other words, the control device 80 moves the sensor 41 in the positive Y-axis direction with respect to the X-axis mark line of the second register mark M2, reverses the positive Y-axis direction to move the sensor in the negative Y-axis direction, and detects the coordinates of both the left and right ends of the X-axis mark line to calculate the coordinates of a point C on the center line of the X-axis mark line. In addition, the control device 80 also moves the sensor 41 in the positive X-axis direction with respect to the Y-axis mark line, reverses the positive X-axis direction to move the sensor in the negative X-axis direction, and detects the coordinates of the upper and lower ends of the Y-axis mark line to calculate the coordinates of a point D on the center line of the Y-axis mark line.

By using the coordinates of the points A to D on the center lines of the X-axis and Y-axis mark lines in the two reference figures M1 and M2, which are reference figures, the control device 80 calculates intersections P1 and P2 (FIG. 15A) of the X-axis and Y-axis mark lines, which are reference points of the respective register marks M1 and M2. In other words, a perpendicular line is drawn from the point A with respect to straight lines running through the two calculated points B and D, and its intersection becomes the reference point P1 of the register mark M1. Similarly, a perpendicular line is drawn from the point C with respect to straight lines running through the points B and D, and the coordinate of its intersection P2 becomes the reference point of the reference figure M2. These coordinate values are stored in the storage means. Further, in the same sequence, reference points P3 and P4 of the reference figures M3 and M4 are calculated, and the control device 80 stores and holds these coordinate values.

The control device 80 corrects the cut data transmitted from the host apparatus, such as a computer, on the basis of the coordinate values of the calculated reference points P1 to P4, and controls the X-axis driving control device 82 and the Y-axis driving control device 83 on the basis of the corrected cut data. The control device 80 moves the paper sheet material 7 in the X-axis direction and also moves the pen block 4 in the Y-axis direction, thereby moving the pen block 4 along a locus corresponding to a profile of a box to be cut that is indicated by a dashed dot line in FIG. 12. A the same time, the control device 80 controls the driving of the Z-axis driving control device 84 to selectively go down the cutting pen 5, thereby bringing the cutting pen into press contact with the paper sheet material 7 to then cut the paper sheet material 7.

With this configuration, according to the present invention, it is possible to exactly match the profile with the pre-formed record and to cut the paper sheet material. Also, it is possible to automatically perform the reading operation of the register mark, which is a reference mark.

The paper sheet material 7 to be cut is previously adhered and supported on the sheet type member by means of the adhesive layer to form a cut target medium, and the cut target medium supporting sheet is interposed between the driving roller and the driven roller. Then, the cut target medium supporting sheet is driven in the first direction, and the cutting pen is moved in the second direction perpendicular to the first direction, thereby cutting the paper sheet material.

[Eighth Embodiment]

Figure 16:
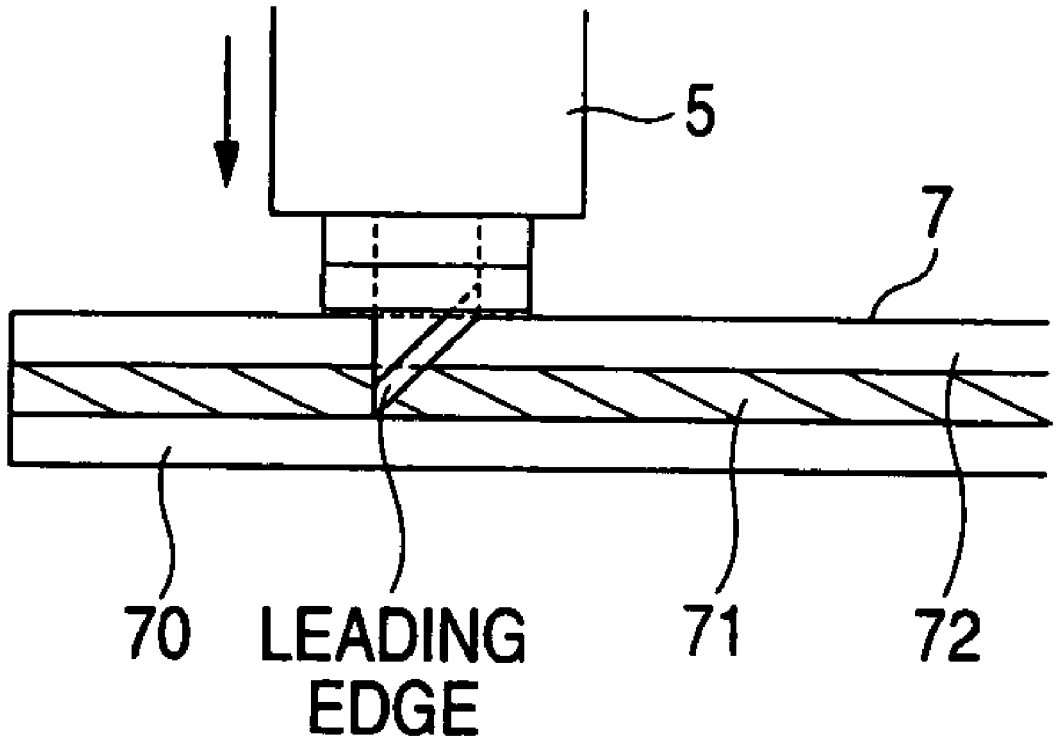
FIG. 16 is a view showing a cut target medium of the present invention.

FIG. 16 shows a cut target medium 7 of the present invention, and the cut target medium 7 includes a sheet type base 70, an adhesive layer 71 where the base 70 is provided on a surface opposite to a cutting pen 5, and a sheet type paper 72 removably adhered and supported on the adhesive layer 71.

In the case in which the cut target medium is cut in a desired shape by means of the medium driving type cutting plotter of the present invention to manufacturing a paper product, first, the operator inserts both ends of the cut target medium 7 between the driving roller 2 and the pinch roller 3 of the cutting plotter. In this state, the cutting plotter becomes a standby state.

When the cut target medium 7 is set to the cutting plotter 1, cut data for cutting is transmitted from a host apparatus, such as a computer, and a control unit (not shown) of the cutting plotter performs a cutting operation on the cut target medium 7 on the basis of the cut data.

In the cutting operation of the cut target medium 7, the control unit allows the cutting pen 5 to be brought into press contact with or separated from the cut target medium 7 by an actuator (not shown) of a pen block 4 and moves the pen block 4 holding the cutting pen 5 in the Y-axis direction. At the same time, the control unit rotates the driving roller 2 to move the cut target medium 7 in the X-axis direction. In this way, the cutting pen 5 moves in a two-dimensional direction relative to the cut target medium 7 on the basis of the cut data, and thus the cut target medium 7 is cut.

In this cutting operation, as shown in FIG. 16, the projection amount of the leading edge of the blade of the cutting pen 5 is set such that the leading edge of the blade of the cutting pen 5 cuts (passes through) the sheet type paper 72 to arrive at the adhesive layer 71 (or the base 70) and does not completely pass through the base 70. In this state, the pen block 4 and the driving roller 2 are driven to cut the sheet type paper 72.

Therefore, the product manufactured by the cutting operation is completely stripped off from the sheet type paper 72. However, when the product is separated, the product is still being adhered and held on the adhesive layer 71. Therefore, the product does not fall away from the base 70.

When the cutting operation is completed, the cut target medium 7 is extracted by releasing the engagement between the pinch roller 3 and the driving roller 2, and the product portion is stripped off and separated from the cut target medium 7. At this time, since the product portion is completely separated from the sheet type paper 72 and the adhesive strength of the adhesive layer 71 is weak, it is possible to strip off the product portion in a simple and easy manner.

Further, since paper dust generated when the sheet type paper 72 is cut adheres to the adhesive layer 71, the paper dust is not deposited on the leading edge of the blade of the cutting pen 5.

Furthermore, the cut target medium supporting sheet is formed of, for example, a thin plastic sheet, so that it is possible to excellently cut the sheet type paper 72 although the paper sheet material 7 to be cut is formed of a thin, weak material, such as tracing paper.

A cap portion that is constructed to be detachable to a holder for supporting the cutter blade is provided. In the cap portion, a leading edge portion of the cutter blade projects from a lower end surface thereof coming into press contact with the cut target medium when attached to the holder and is attached to the holder. When the cap portion is attached to the holder, the leading edge of the cutter blade protrudes by a predetermined specific projection amount. Further, the axial length of the cutter blade of the cap portion is determined according to the type of a medium to be cut, and the cap portion is attached to the holder when the medium is cut. Thereby, the projection amount of the leading edge of the cutter blade projecting from the lower end surface of the cap portion is set to the optimal projection amount with respect to the medium to be cut. Furthermore, an individual mark is given to each of a plurality of cap portions, and the cap portion to be mounted to the holder is selected by the mark according to the type of the medium to be cut. In addition, an individual color is given to each of the plurality of cap portions, and the cap portion to be mounted to the holder is selected by the color according to the type of the medium to be cut.

[Ninth Embodiment]

Figure 17:
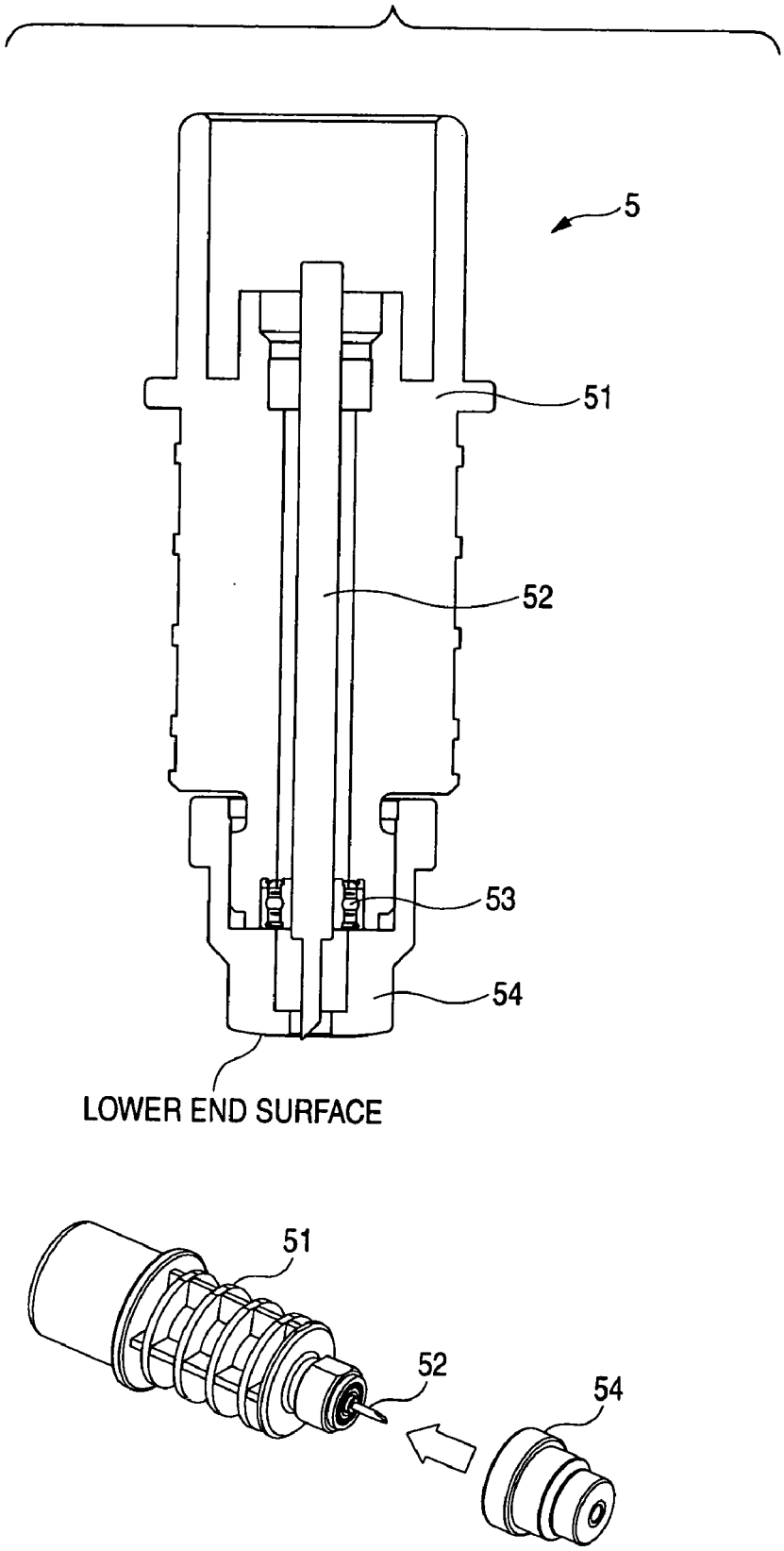
FIG. 17 is a view showing a configuration of a cutting pen according to the present invention.

FIG. 17 is a cross-sectional view showing a configuration of a cutting pen 5 according to the present invention. In FIG. 17, reference numeral 51 indicates a holder formed in a cylindrical shape, which is a main body of the cutting pen 5, reference numeral 52 indicates a cutter blade where an edge is formed on a tip portion, reference numeral 53 indicates a bearing fixed in the holder 51 and rotatably supporting the cutter blade 52, and reference numeral 54 indicates a cap portion.

The cap portion 54 is formed in the shape of a cylinder inside a center portion of which a spiral groove is formed so as to be screwed to the holder 51. The cap portion is configured to be detachable to the holder by rotation. Further, the center portion of a lower end surface brought into press contact with a medium to be cut is formed with an opening through which the leading edge of the cutter blade 52 passes. Therefore, when the cap portion 54 is mounted to the holder 51, the leading edge of the cutter blade 52 supported to the holder 51 passes through the opening, and thus a leading end portion thereof projects from the lower end surface of the cap portion 54.

The cutting pen of the present invention is provided with plural kinds of cap portions 54, as shown in FIGS. 18A to 18F. In the present embodiment, the three cap portions 54(*a*) to 54(*c*) are each formed in such a manner that the axial lengths of the cutter blades 52, that is, distances D1, D2, and D3 from an upper end side of its holder 51 to the lower end surface from which the leading edge of the cutter blade 52 projects when the holder 51 is mounted are different from each other, and that projection amounts C1, C2, and C3 (from the lower end surface) of the cutter blades 52 are different from each other when these cap portions 54(*a*) to 54(*c*) are mounted to the holders 51. (Here, in all cases, there is no change in the relative position relation between the cutter blade 52 and the holder 51).

Now, it is assumed that the lengths D1, D2, and D3 of the respective cap portions 54 are set and formed such that the projection amount C1 of the leading edge of the cutter blade 52 becomes 0.1 mm when the first cap portion 54(*a*) is mounted to the holder 51, the projection amount C2 of the leading edge of the cutter blade 52 becomes 0.2 mm when the second cap portion 54(*b*) is mounted in the holder 51, and the projection amount C3 of the leading edge of the cutter blade 52 becomes 0.3 mm when the third cap portion 54(*c*) is mounted in the holder 51. Further, it is assumed that there are previously set cutting conditions that the optimal projection amount is 0.1 mm when the cutting pen 5 is used to cut a thin film (a cutting film obtained by laminating a template and an adhesive sheet) by the cutting plotter, the optimal projection amount is 0.2 mm when a thick film (cutting film) or a thin sheet material is cut, and the optimal projection amount is 0.3 mm when the other paper sheet materials are cut.

In the case in which the sheet material is cut by means of the cutting plotter employing the cutting pen of the present invention, first, an operator selects the cap portion 54 corresponding to the type of a sheet material to be cut. In other words, when the medium to be cut is a thin film, such as a cutting film, the first cap portion 54(*a*) having the axial length D1 is selected from the plurality of cap portions 54 and is mounted to the holder 51 of the cutting pen 5. When the first cap portion 54(*a*) is mounted to the holder 51, the projection amount of the leading edge of the cutter blade 52 thereof is naturally set to C1, i.e., 0.1 mm. When the first cap portion 54(*a*) is mounted to the holder 51, the operator mounts the first cap portion to the cutting plotter and then performs a cutting operation.

Similarly, when the medium to be cutting is a thick film or a thin sheet material, such as copying paper or label paper, among the plurality of cap portions 54, the second cap portion 54(*b*) having the axial length D2 is selected. Further, when the medium to be cut is a paper sheet material, such as kent paper, among the plurality of cap portions 54, the third cap portion 54(*c*) having the axial length D3 is selected and is then mounted to the holder 51 of the cutting pen 5. When the second cap portion 54(*b*) is mounted to the holder 51, the projection amount of the leading edge of the cutter blade 52 thereof is naturally set to C2, i.e., 0.2 mm. Further, when the third cap portion 54(*c*) is mounted to the holder 51, the projection amount of the leading edge of the cutter blade 52 thereof is naturally set to C3, i.e., 0.3 mm.

In this manner, in the cutting pen of the present invention, the adjustment of the projection amount of the cutter blade enables the operator to select the cap portion 54 according to the type of a medium to be cut and to mount the selected cap portion to the holder 51. Therefore, it is possible to set the projection amount of the cutter blade in an easy and exact manner.

Figure 18A:
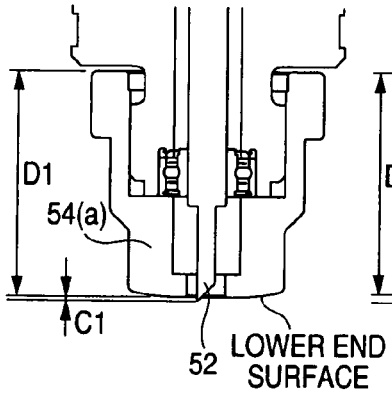
FIGS. 18A to 18F are views showing a cap portion in the cutting pen according to the present invention.
Figure 18B:
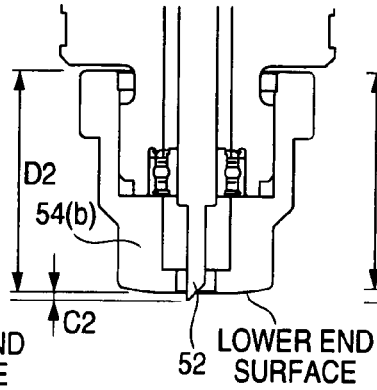
Figure 18C:
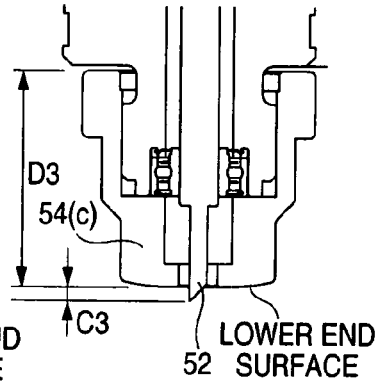
Figure 18D:
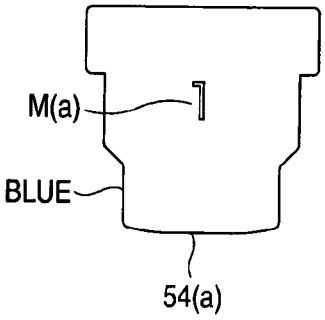
Figure 18E:
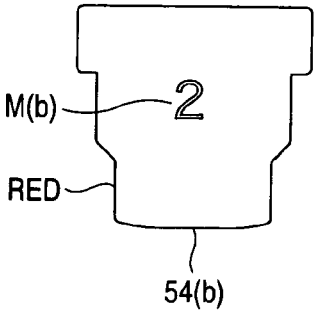
Figure 18F:
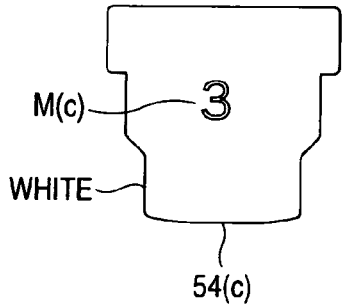

As shown in FIGS. 18D to 18F, the first to third cap portions 54(*a*) to 54(*c*) are provided with the marks M(a) to M(c) or colors, respectively. For example, the first cap portion 54(*a*) is painted with blue, the second cap portion 54(*b*) is painted with red, and the third cap portion 54(*c*) is painted with white (alternatively, materials having the respective colors may be used). In this case, the selection of the cap portion 54 by the operator, that is, the setting of the projection amount of the leading edge of the cutter blade becomes easier.

In other words, the number '1' (or blue) cap portion 54 is used when the medium to be cut is a thin film, the number '2' (or red) cap portion 54 is used when the medium to be cut is a thick film or a thin paper sheet, and the number '3' (or white) cap portion 54 is used when the medium to be cut is the other paper sheet materials. This enables the operator to easily select the cap portion 54.

[Tenth Embodiment]

Next, a driving control device of a cutting plotter employing a cutting pen of the present invention will be described.

Figure 19:
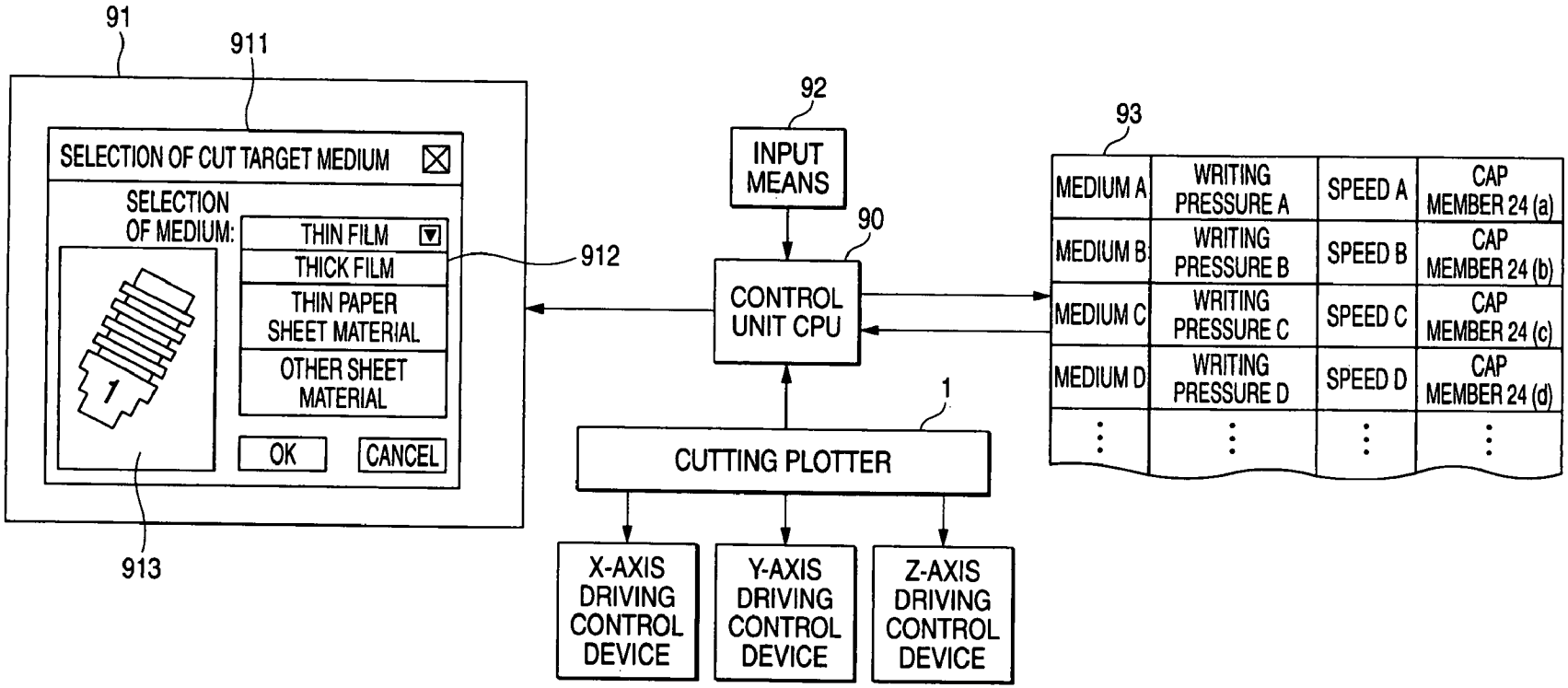
FIG. 19 is a block diagram showing a driving controlling device of the cutting plotter employing the cutting pen of the present invention.
Figure 20:
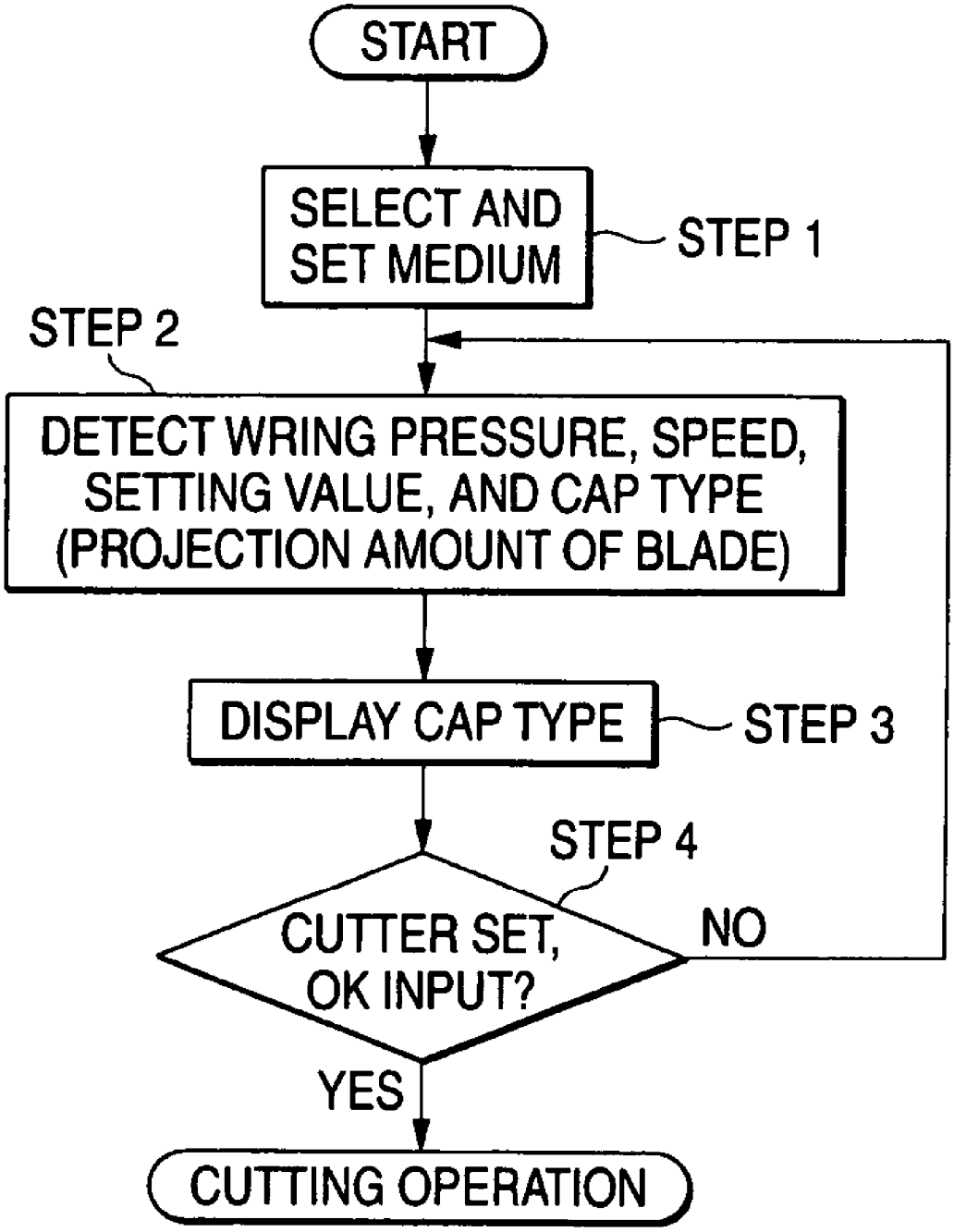
FIG. 20 is a view showing a method of setting cutting conditions of the cutting plotter employing the cutting pen of the present invention.
Figure 21:
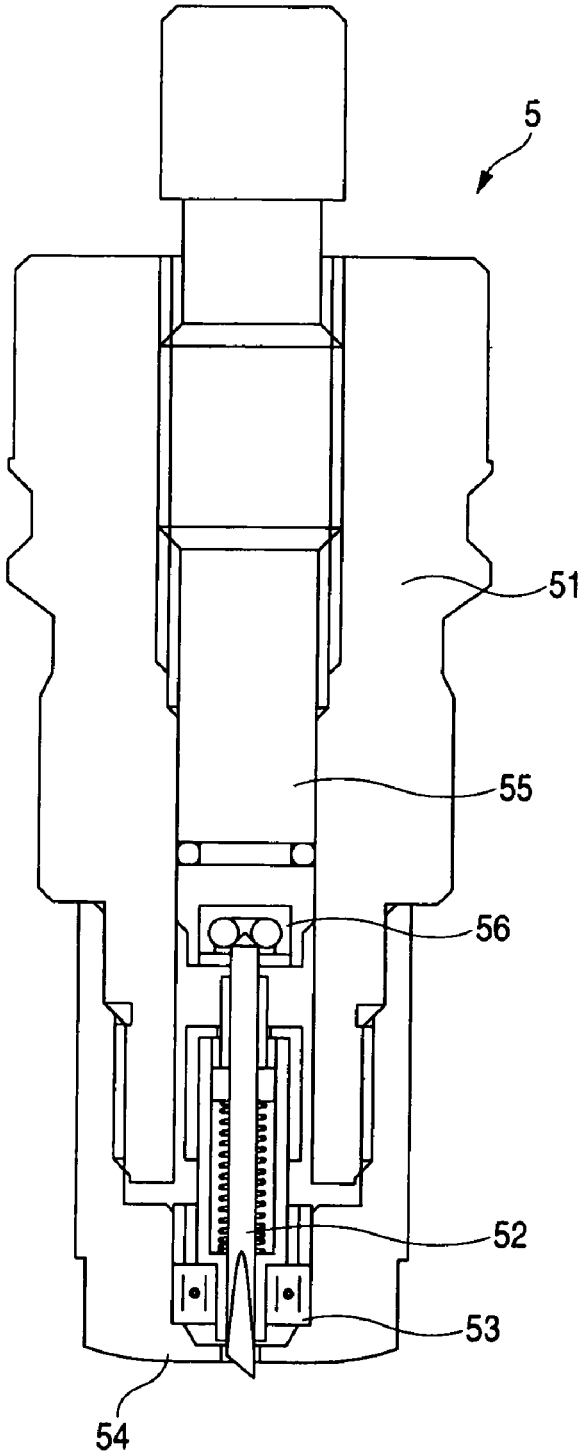
FIG. 21 RELATED ART
FIG. 21 is a view showing a configuration of a conventional cutting pen.

FIG. 19 is a block diagram showing a configuration of the driving control device of the cutting plotter employing the cutting pen of the present invention. In FIG. 19, reference numeral 90 indicates a control unit for performing various controls, reference numeral 91 indicates a display means, such as a monitor, reference numeral 93 indicates a storage means in which various setting conditions are stored and held, reference numeral 92 indicates an input means made up of, for example, a mouse or a keyboard, which performs the input and instruction of various data or commands, and reference numeral 1 indicates a cutting plotter. Further, FIG. 20 is a flow chart showing a procedure of setting cutting conditions in the driving control device.

In the case in which the sheet type medium is cut by means of the cutting plotter 1, before cut data is transmitted to the cutting plotter 1 to perform a cutting operation, the cutting conditions corresponding to the sheet material to be cut are set.

The operational conditions includes, for instance, a drawing speed (the movement speed of the cutting pen), acceleration (the movement acceleration of the cutting pen), writing pressure (compressive pressure against the medium when the cutting pen cuts the medium), a projection amount of an leading edge of a blade (i.e., information on the type of a cap portion in the cutting pen of the present invention), and so forth. The drawing speed and the acceleration are particularly involved in the precision of a cut target figure to be formed. When a slim cut target figure is formed, these values are preferably set to be small. Further, the writing pressure and the projection amount of the leading edge of the blade are particularly involved in the type of a medium to be cut. Therefore, it goes without saying that it is necessary to adjust the projection amount of the leading edge in correspondence to the thickness of the medium as mentioned above, and the writing pressure is preferably increased with respect to a medium having a thick thickness and high stiffness.

In the driving control device of the cutting plotter employing the cutting pen of the present invention, the combinations of these various setting conditions are stored in advance according to the type of the medium in terms of an optimal value of each parameter, and only the selection of the type of the medium to be cut by the operator make is possible to set each condition stored and held.

In the setting operation of the cutting conditions, the control unit 90 allows the display means 91 to display a 'cut target medium selecting window' 911 for setting various conditions of the cutting operations. The cut target medium selecting window 911 has a medium type selection and display window 912 for displaying a medium type list which is previously stored in the storage means 93 and a cap portion display window 913 for displaying information on the cap portion among the setting conditions corresponding to the type of the selected medium.

The operator manipulates the input means 92 while viewing the cut target medium selection window 911 to select the type of a medium to be cut from the contents on the medium type selection and display window 912 (STEP 1 in FIG. 20). When the medium to be cut is selected, the control unit 90 reads out the cutting conditions of the selected medium from the data in the storage means 93 (STEP 2), and displays the type of the cap portion corresponding to the selected medium on the cap portion display window 913 of the display means 91 on the basis of information on the cap portion among the read cutting conditions (STEP 3).

Referring the present embodiment in comparison with the above-mentioned ninth embodiment, the storage means 93 stores and holds the following setting conditions data of the first cap portion 54(*a*) having a mark '1' and a color 'blue' is stored in (1) a field 'thin film', data of the second cap portion 54(*b*) having a mark '2' and a color 'red' is stored in (2) fields 'thick film' and 'thin sheet material', and data of the third cap portion 54(*c*) having a mark '3' and a color 'white' is stored in (3) a field 'other sheet materials'. Further, fields 'thin film,' 'thick film,' 'thin sheet material, ' and 'paper sheet material' as the type of the medium to be cut are displayed on the medium type selection and display window 912 of the display means 91 such that they can be selected. When the operator selects the 'thin film' as the type of the medium to be cut through the medium type selection and display window 912 of the display section 91, the control unit 90 reads out the cutting conditions corresponding to the 'thin film' from the data of the storage means 93, and reads out information on the cap portion from the read cutting conditions, that is, in this case, information on the cap portion 54(*a*) to draw and display the cap portion 54(*a*) which is given the mark '1' and painted with blue on the cap portion display window 913 of the display means 91. (Similarly, when the 'thick film' or 'thin sheet material' is selected, the control unit 90 reads out the cutting conditions corresponding to the 'thick film' or 'thin sheet material' from the data of the storage means 93, and reads out information on the cap portion 54(*b*) from the read cutting conditions to draw and display the cap portion 54(*b*) which is given the mark '2' and painted with red on the cap portion display window 913 of the display means 91. Further, when the 'paper sheet material' is selected, the control unit 90 reads out the cutting conditions corresponding to the 'paper sheet material' from the data of the storage means 93, and reads out information on the cap portion 54(*c*) from the read cutting conditions to draw and display the cap portion 54(*c*) which is given the mark '3' and painted with white on the cap portion display window 913 of the display means 91.)

The operator confirms the display of the cap portion display section 913 to select the cap portion having the mark '1' or blue color from the plurality of cap portions 54, mounts the selected cap portion to the holder 51 of the cutting pen 5, and then mounts the cutting pen 5 to the cutting plotter 1. When the selection of the cap portion 54, the mounting thereof to the holder 51, and the setting of the cutting pen 5 are completed, the operator operates the input means 92 to push an 'OK' button of the cut target medium selection window 911 or push an execution key on a keyboard, thereby completing the cutting condition setting operation (STEP 4).

When the setting of the cutting conditions is completed, the control unit 90 moves the pen block 4 holding the cutting pen 5 in the two-dimensional direction relative to the sheet type medium 7 (the X-axis and Y-axis driving devices), and simultaneously allows the cutting pen 5 supported on the pen block 4 to be brought into press contact with and separated from the sheet type medium 7 (the Z-axis driving device), thereby cutting the sheet type medium 7.

In this manner, in the driving control device of the cutting plotter employing the cutting pen of the present invention, when the operator have only to select the type of a medium to be cut, the operator checks which of the plurality of cap portions is selected on the display means, so that it is possible to perform visual determination and thus to exactly and easily set the optimal projection amount of the leading edge with respect to the medium to be cut.

What is claimed is:

1. A cut target medium driving type cutting plotter, in which a cut target medium to be cut is driven in a first direction and a cutting unit is driven in a second direction perpendicular to the first direction, thereby moving the cutting unit in a two-dimensional direction relative to the cut target medium to make the cutting unit to be selectively brought into press contact with and separated from the cut target medium to cut the cut target medium in a desired shape, the cut target medium driving type cutting plotter comprising:

a cut target medium supporting sheet to removably support the cut target medium on a surface opposite to the cutting unit, wherein the cut target medium is driven in the first direction together with the cut target medium supporting sheet, the cut target medium supported on the cut target medium supporting sheet is cut by the cutting unit, the cutting unit is configured by a control unit to cut to a predetermined cutting depth not completely through the cut target medium supporting sheet, the predetermined cutting depth is configured based upon a compression pressure of a cutting pen on the cut target medium and a projection amount of a blade of the cutting pen selected by a user, the desired shape is completely cut by the cutting unit, a face of the cut target medium supporting sheet, the face being configured to support the cut target medium, includes:

a first mark configured to facilitate positioning of the cut target medium; and a second mark configured to facilitate matching of the cut target medium with a coordinate axis, wherein the second mark is a grid-shaped graph paper scale.

2. The cut target medium driving type cutting plotter according to claim 1, wherein the cut target medium supporting sheet is provided with an adhesive layer for removably supporting the cut target medium on the surface opposite to the cutting unit.

3. The cut target medium driving type cutting plotter according to claim 1, wherein the first mark is used to locate the cut target medium on the surface opposite to the cutting unit.

4. The cut target medium driving type cutting plotter of claim 1, further comprising:

an adhesive layer disposed directly on the cut target medium supporting sheet without covering edge portions of the cut target medium supporting sheet in a lengthwise direction.

5. The cut target medium driving type cutting plotter of claim 1, further comprising:

a sensor, wherein the sensor detects a mark on the cut target medium by moving along a predetermined diagonal path with respect to the cut target medium.

6. The cut target medium driving type cutting plotter of claim 1, further comprising:

a sensor, wherein the sensor detects a mark on the cut target medium by moving along a series of predetermined diagonal paths of increasing length with respect to the cut target medium.

7. A cut target medium supporting sheet for a cut target medium driving type cutting plotter in which a cut target medium to be cut is driven in a first direction and a cutting unit is driven in a second direction perpendicular to the first direction, thereby moving the cutting unit in a two-dimensional direction relative to the cut target medium to make the cutting unit to be selectively brought into press contact with and separated from the cut target medium to cut the cut target medium in a desired shape, the cutting unit being configured by a control unit to cut to a predetermined cutting depth not completely through the cut target medium supporting sheet, the predetermined cutting depth configured based upon a compression pressure of a cutting pen on the cut target medium and a projection amount of a blade of the cutting pen selected by a user, and the desired shape is completely cut by the cutting unit, the cut target medium supporting sheet comprising:

a sheet type member provided with an adhesive layer to adhere and removably support the cut target medium on a surface thereof, wherein the cut target medium supported by the adhesive layer is moved in the first direction, a face of the cut target medium supporting sheet, the face being configured to support the cut target medium, includes:

a first mark configured to facilitate positioning of the cut target medium; and a second mark configured to facilitate matching of the cut target medium with a coordinate axis, wherein the second mark is a grid-shaped graph paper scale.

8. The cut target medium supporting sheet of claim 7, wherein the adhesive layer is disposed directly on the cut target medium supporting sheet without covering edge portions of the cut target medium supporting sheet in a lengthwise direction.

9. The cut target medium supporting sheet of claim 7, wherein a sensor detects a mark on the cut target medium by moving along a predetermined diagonal path with respect to the cut target medium.

10. The cut target medium supporting sheet of claim 7, wherein a sensor detects a mark on the cut target medium by moving along a series of predetermined diagonal paths of increasing length with respect to the cut target medium.

11. A cut target medium for a cut target medium driving type cutting plotter in which the cut target medium is driven in a first direction and a cutting unit is driven in a second direction perpendicular to the first direction at the same time, thereby moving the cutting unit in a two-dimensional direction relative to the cut target medium to make the cutting unit to be brought into pressing contact with and separated from the cut target medium to cut the cut target medium in a desired shape, the cut target medium comprising:

a sheet type member, an adhesive layer formed on a surface of the sheet type member, and a sheet type paper removably supported on the adhesive layer, wherein the cut target medium is moved in the first direction, the sheet type paper removably supported on the adhesive layer is cut in the desired shape by the cutting unit, the cutting unit is configured by a control unit to cut to a predetermined cutting depth not completely through a cut target medium supporting sheet, the predetermined cutting depth configured based upon a compression pressure of a cutting pen on the cut target medium and a projection amount of a blade of the cutting pen selected by a user, the desired shape is completely cut by the cutting unit, a face of the cut target medium, the face being configured to support the sheet type paper, includes:

a first mark configured to facilitate positioning of the sheet type paver; and a second mark configured to facilitate matching of the sheet type paper with a coordinate axis, wherein the second mark is a grid-shaped graph paper scale.

12. The cut target medium of claim 11, wherein, the adhesive layer is disposed directly on the sheet type member without covering edge portions of the sheet type member in a lengthwise direction.

13. The cut target medium of claim 11, wherein a sensor detects a mark on the cut target medium by moving along a predetermined diagonal path with respect to the cut target medium.

14. The cut target medium of claim 11, wherein a sensor detects a mark on the cut target medium by moving along a series of predetermined diagonal paths of increasing length with respect to the cut target medium.

* * * * *